US010415305B2

(12) United States Patent
Huang et al.

(10) Patent No.: US 10,415,305 B2
(45) Date of Patent: Sep. 17, 2019

(54) WINDOW SHADE

(71) Applicant: Teh Yor Co., Ltd., Taipei (TW)

(72) Inventors: Chin-Tien Huang, New Taipei (TW); Chien-Lan Huang, New Taipei (TW)

(73) Assignee: Teh Yor Co., Ltd., Taipei (TW)

( * ) Notice: Subject to any disclaimer, the term of this patent is extended or adjusted under 35 U.S.C. 154(b) by 216 days.

(21) Appl. No.: 15/624,899

(22) Filed: Jun. 16, 2017

(65) Prior Publication Data

US 2017/0362890 A1 Dec. 21, 2017

Related U.S. Application Data

(60) Provisional application No. 62/351,352, filed on Jun. 17, 2016.

(51) Int. Cl.
*E06B 9/34* (2006.01)
*E06B 9/303* (2006.01)
(Continued)

(52) U.S. Cl.
CPC ..... *E06B 9/34* (2013.01); *E06B 9/24* (2013.01); *E06B 9/303* (2013.01); *E06B 9/322* (2013.01);
(Continued)

(58) Field of Classification Search
CPC ..... E06B 9/34; E06B 9/24; E06B 9/40; E06B 9/42; E06B 9/303; E06B 9/322;
(Continued)

(56) References Cited

U.S. PATENT DOCUMENTS 8,757,237 B2 * 6/2014 Aoki ..... E06B 9/262 160/120
2010/0206494 A1 8/2010 Tait et al.
(Continued)

FOREIGN PATENT DOCUMENTS

CN 102383687 A 3/2012
CN 102755096 A 10/2012
(Continued)

OTHER PUBLICATIONS

Office Action dated Nov. 21, 2017 in co-pending Taiwan Patent Application No. 106119999, with English translation (last pages).
(Continued)

*Primary Examiner* — Beth A Stephan
(74) *Attorney, Agent, or Firm* — Chen Yoshimura LLP

(57) ABSTRACT

A window shade includes a reel and a roller pivotally connected with a head frame at two spaced-apart positions, a clutch operatively connected with the roller and switchable between an engaged state preventing the roller from rotating in a first direction and a disengaged state for rotation of the roller in an opposite second direction, and a panel assembly including multiple transversal vanes respectively connected with a first and a second panel. The reel is rotatable to wind and unwind the panel assembly with the first panel remaining in contact with the roller. The panel assembly is switchable between an open state for light passage and a closed state blocking light passage by rotating the transversal vanes. The reel is rotatable in an unwinding direction while the roller is kept stationary by the clutch in the engaged state for switching the panel assembly from the closed to open state.

25 Claims, 22 Drawing Sheets

(51) Int. Cl.

| | |
|---|---|
| ***E06B 9/322*** | (2006.01) |
| ***E06B 9/323*** | (2006.01) |
| ***E06B 9/326*** | (2006.01) |
| ***E06B 9/78*** | (2006.01) |
| ***E06B 9/24*** | (2006.01) |

(52) U.S. Cl.
CPC ..... *E06B 9/323* (2013.01); *E06B 9/326* (2013.01); *E06B 9/78* (2013.01); *E06B 2009/2435* (2013.01); *E06B 2009/785* (2013.01)

(58) Field of Classification Search
CPC . E06B 9/323; E06B 9/326; E06B 9/78; E06B 2009/2435; E06B 2009/785
See application file for complete search history.

(56) References Cited

U.S. PATENT DOCUMENTS

| | | | | |
|---|---|---|---|---|
| 2011/0061821 | A1* | 3/2011 | Kim | E06B 9/264 160/305 |
| 2012/0222828 | A1 | 9/2012 | Kwak | |
| 2013/0056162 | A1* | 3/2013 | Aoki | E06B 9/262 160/87 |
| 2013/0098563 | A1* | 4/2013 | Jang | E06B 9/42 160/120 |
| 2013/0240156 | A1* | 9/2013 | Jang | E06B 9/42 160/120 |
| 2013/0306250 | A1* | 11/2013 | Mullet | E06B 9/40 160/120 |
| 2014/0262066 | A1* | 9/2014 | Certain | E06B 9/26 160/84.02 |
| 2017/0037679 | A1* | 2/2017 | An | E06B 9/34 |

FOREIGN PATENT DOCUMENTS

| | | |
|---|---|---|
| JP | 2013536340 | 9/2013 |
| KR | 100998173 | 12/2010 |
| KR | 101260918 | 5/2013 |
| KR | 1020140113586 | 9/2014 |
| TW | 200831771 A | 1/1997 |
| TW | I493102 B | 7/2015 |
| WO | 2011078583 A2 | 6/2011 |
| WO | 2014143057 A1 | 9/2014 |

OTHER PUBLICATIONS

2nd OA in co-pending TW Application No. 106119999 (with separate English translation) dated Apr. 13, 2018.
Office Action dated Aug. 7, 2018 in co-pending Korean Patent Application No. 10-2017-0075593.
International Search Report and Written Opinion dated Sep. 25, 2017 in co-pending PCT Appl. No. PCT/US2017/037870.

* cited by examiner

WINDOW SHADE

CROSS-REFERENCE TO RELATED APPLICATION(S)

This application claims priority to U.S. Provisional Patent Application No. 62/351,352 filed on Jun. 17, 2016, the disclosure of which is incorporated herein by reference.

BACKGROUND

1. Field of the Invention

The present invention relates to window shades.

2. Description of the Related Art

Many types of window shades are currently available on the market, such as roller shades, Venetian blinds and honeycomb shades. Conventionally, the window shade is provided with an operating cord that can be actuated to raise and lower the window shade. Certain types of window shades may include a panel assembly having multiple transversal strips that may be adjusted to close or open the panel assembly. This function requires a suitable actuating mechanism provided in the window shade. Usually, window shade products available on the market adopt a design that can open the panel assembly for light passage only after it is lowered to its bottommost position, which may not be convenient to use.

Therefore, there is a need for a window shade that is convenient to operate and address the aforementioned issues.

SUMMARY

A window shade described herein includes a head frame, a reel and a roller respectively connected pivotally with the head frame and disposed spaced apart from each other, a clutch operatively connected with the roller, and a panel assembly including a first and a second panel, and a plurality of transversal vanes respectively connected with the first and second panels. The reel is rotatable to wind and unwind the panel assembly with the first panel remaining in contact with the roller, and the panel assembly is switchable between an open state for light passage and a closed state blocking light passage by rotating the transversal vanes. The clutch is switchable between an engaged state preventing the roller from rotating in a first direction, and a disengaged state for rotation of the roller in a second direction opposite to the first direction, wherein the reel is rotatable in an unwinding direction while the roller is kept stationary by the clutch in the engaged state for switching the panel assembly from the closed state to the open state.

Advantages of the window shade described herein includes a relatively simple construction that offers the ability to adjust a vertical position of the panel assembly and close and open the panel assembly at any desired height.

DETAILED DESCRIPTION OF THE EMBODIMENTS

Figure 1:
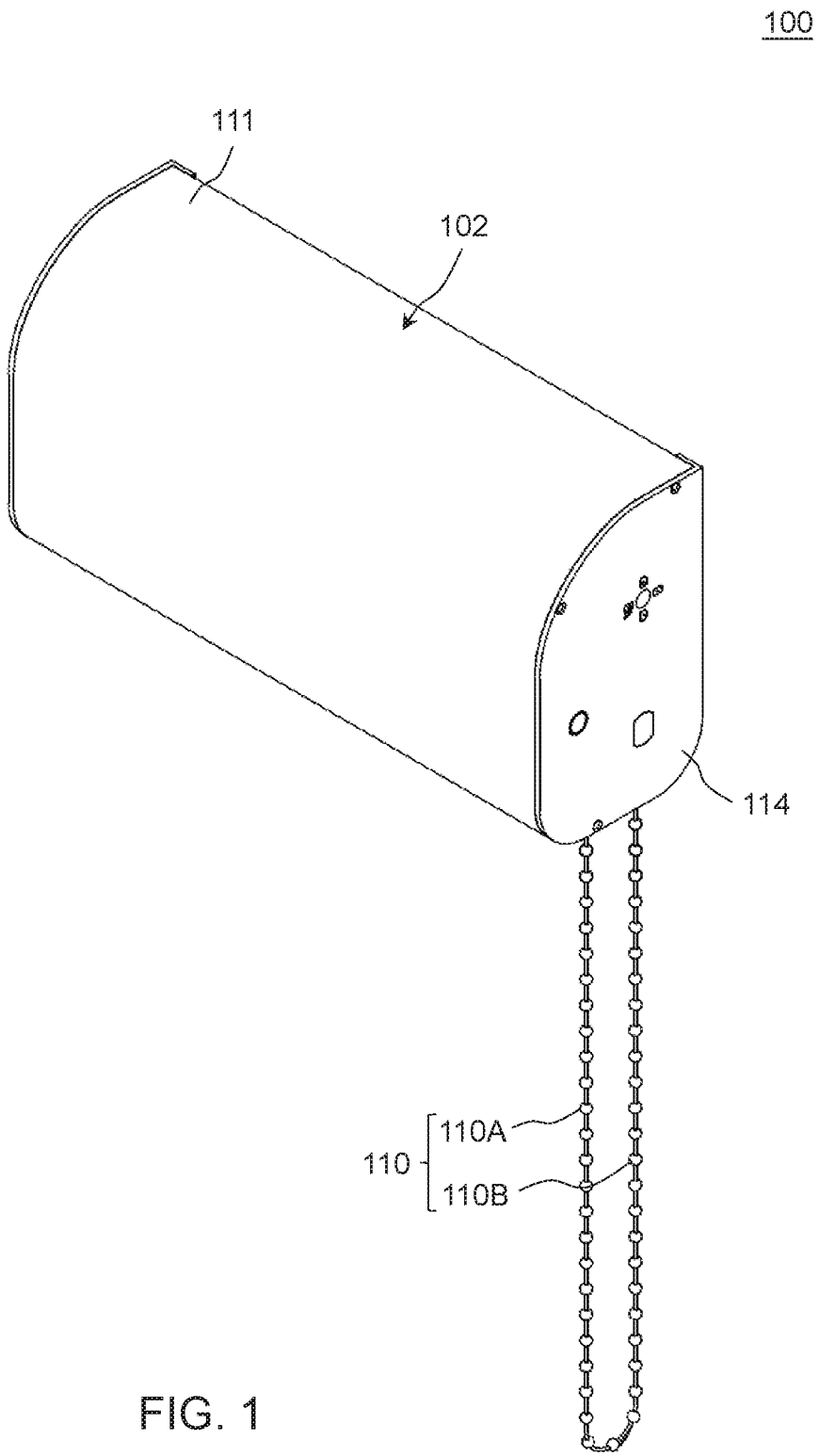
FIG. 1 is a perspective view illustrating an embodiment of a window shade in a fully raised or retracted state.
Figure 2:
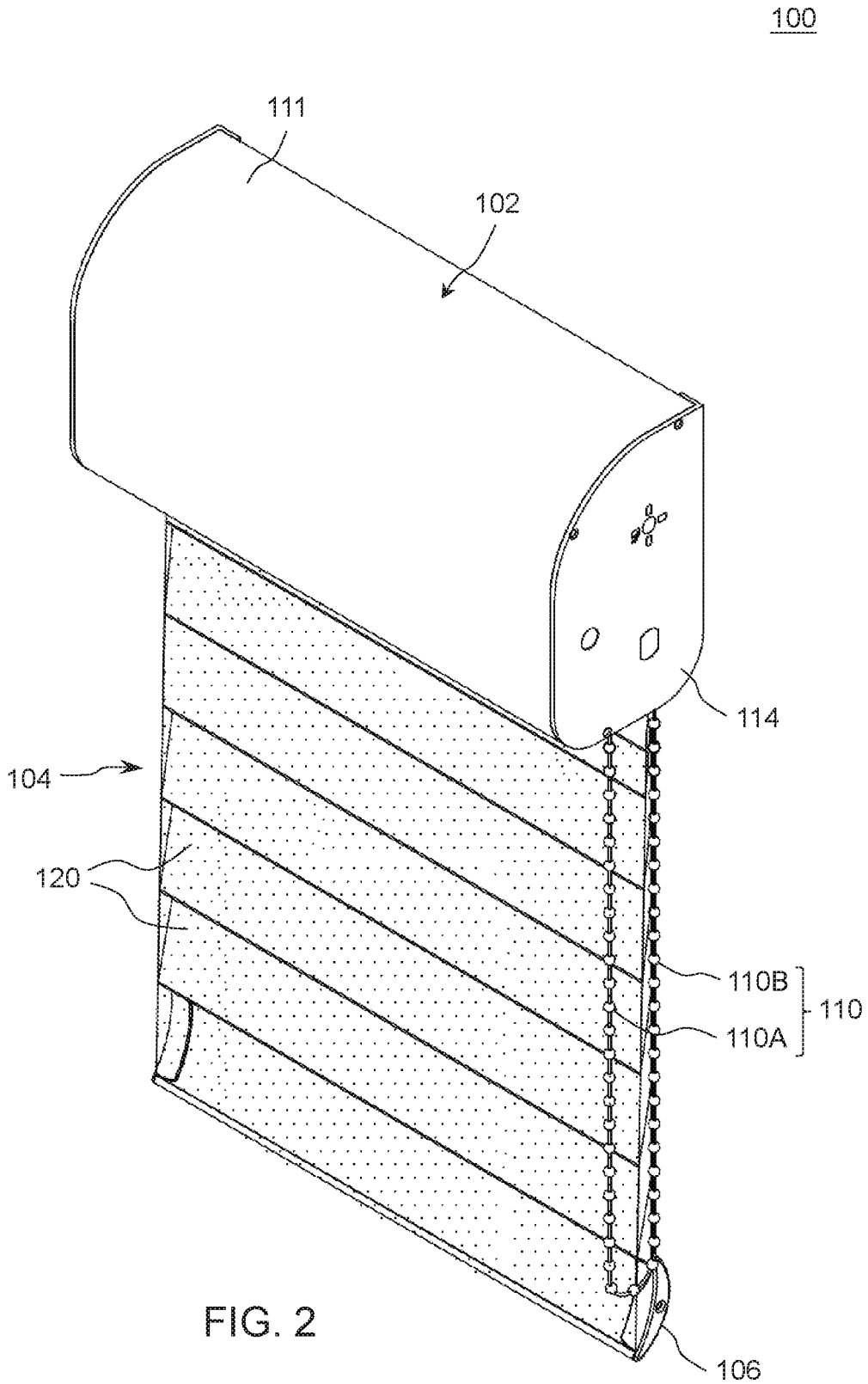
FIG. 2 is a perspective view illustrating the window shade in a lowered and closed state.
Figure 3:
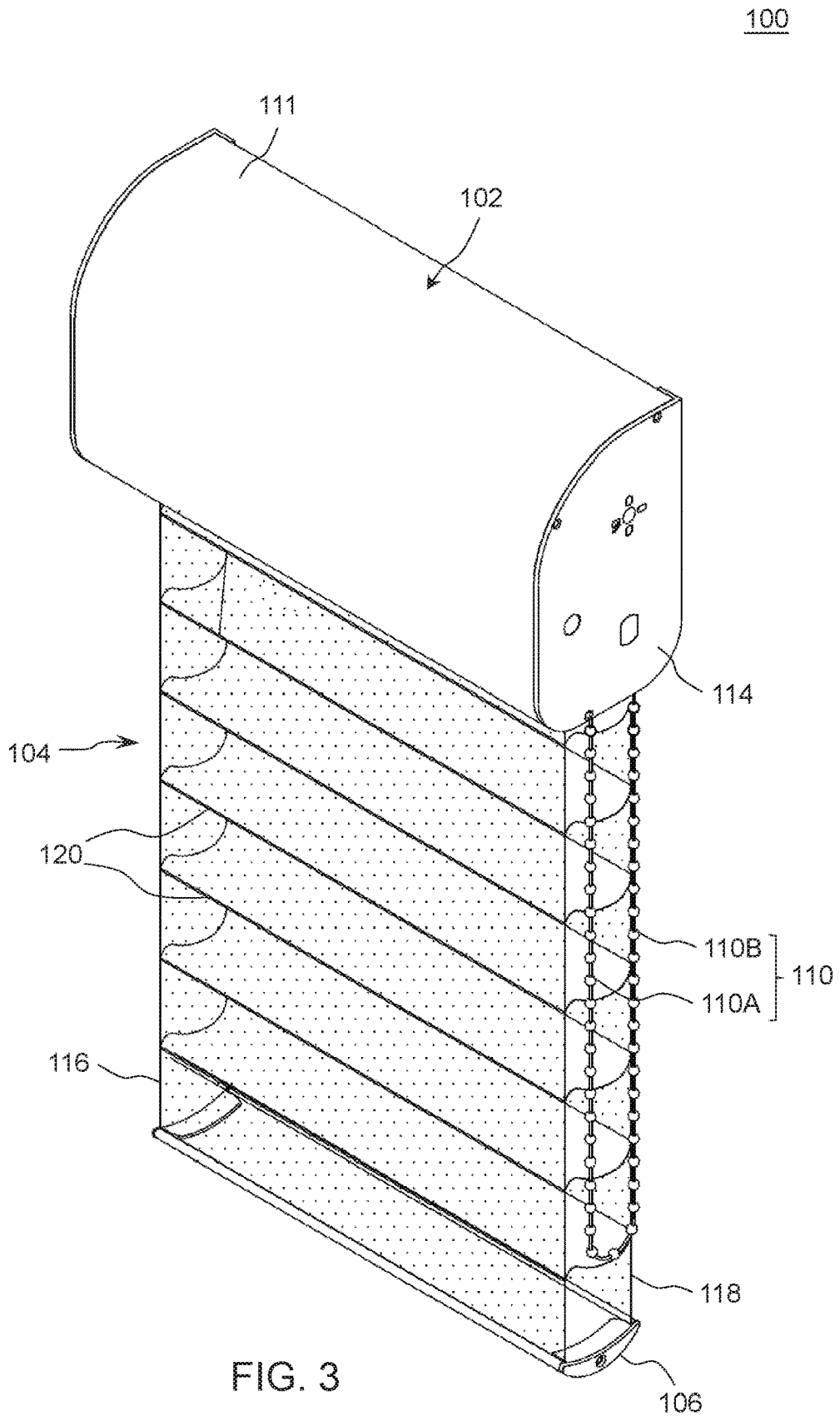
FIG. 3 is a perspective view illustrating the window shade in a lowered and open state.
Figure 4:
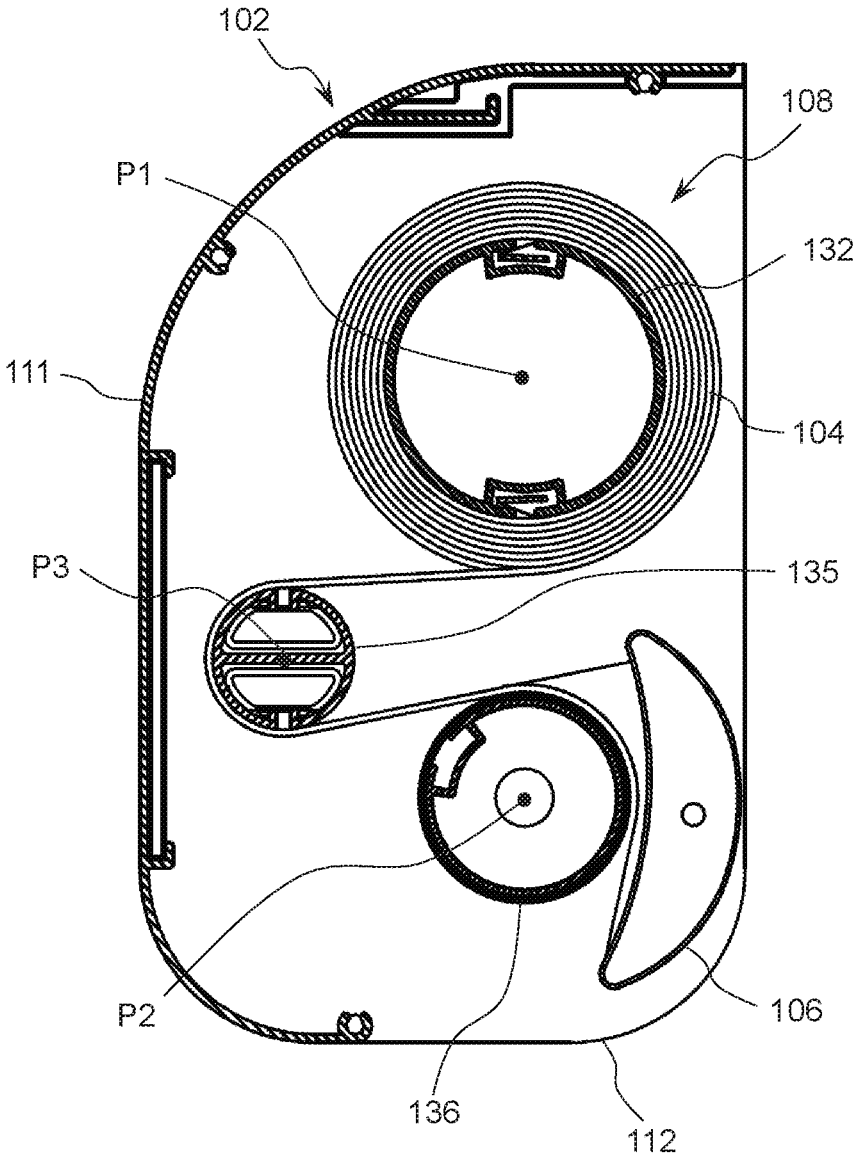
FIG. 4 is a schematic side view illustrating an inner construction of the window shade.
Figure 5:
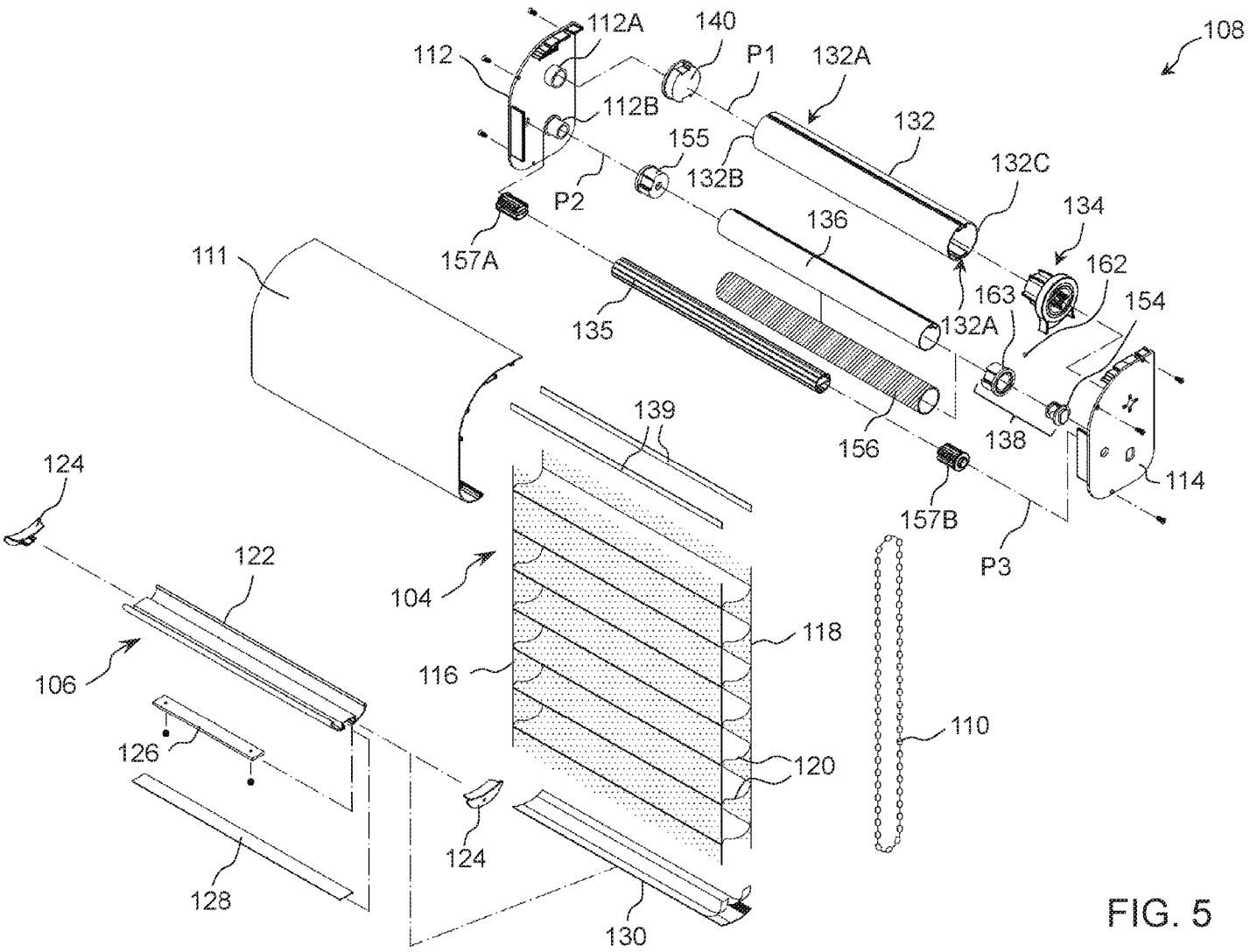
FIG. 5 is an exploded view illustrating a construction of the window shade.

FIGS. 1-3 are perspective views respectively illustrating an embodiment of a window shade 100 in a fully raised or retracted state, a lowered and closed state, and a lowered and open state. FIG. 4 is a schematic side view illustrating an inner construction of the window shade 100, and FIG. 5 is an exploded view illustrating a construction of the window shade 100. Referring to FIGS. 1-5, the window shade 100 can include a head frame 102, a panel assembly 104, a bottom part 106, and an actuating system 108 including an operating member 110 for controlling the movement of the panel assembly 104.

The head frame 102 may be affixed at a top of a window frame, and may have any desirable shapes. According to an example of construction, the head frame 102 can include a cover 111, and two opposite side caps 112 and 114 respectively connected fixedly with a left and a right end of the cover 111. The head frame 102 can have an inner cavity for at least partially receiving the actuating system 108 of the window shade 100.

The panel assembly 104 can have an upper and a lower end respectively connected with the actuating system 108 and the bottom part 106. The panel assembly 104 can include two panels 116 and 118, and a plurality of parallel transversal vanes 120. Each of the two panels 116 and 118 can have a width extending generally horizontally, and a length perpendicular to the width. The transversal vanes 120 are disposed between the two panels 116 and 118, and are respectively connected with the two panels 116 and 118 along the length of the two panels 116 and 118. According to an example of construction, the two panels 116 and 118 and/or the transversal vanes 120 may be made of flexible materials including, but not limited to, fabric materials, web materials, mesh materials, and the like. In some implementation, the two panels 116 and 118 may exemplary include a transparent or translucent fabric material, and the transversal vanes 120 may include an opaque material. The panel assembly 104 can be retracted toward an interior of the head frame 102, and expanded or lowered outside the head frame 102. When the panel assembly 104 is expanded or lowered outside the head frame 102 at any given height, the panel assembly 104 is further switchable between a closed state and an open state by imparting a relative displacement between the two panels 116 and 118 that rotates the transversal vanes 120. When the panel assembly 104 is in the closed state, the transversal vanes 120 are substantially vertical and vertically overlap with one another for blocking light passage, as shown in FIG. 2. When the panel assembly 104 is in the open state, the transversal vanes 120 can be turned generally horizontally parallel to one another and define a plurality of gaps 121 in the panel assembly 104 for light passage, as shown in FIG. 3. The vertical position of the panel assembly 104 and its switching between the closed and open state may be controlled by the actuating system 108, which will be described hereinafter in more details.

The bottom part 106 is disposed at a bottom of the panel assembly 104 as a weighing structure, and is movable vertically along with the panel assembly 104 as the panel assembly 104 is retracted toward or expanded from the head frame 102. Referring to FIG. 5, the bottom part 106 may exemplary include a rigid rail 122 having an elongate shape, and two opposite end caps 124 respectively attached to a left and a right end of the rigid rail 122. A detachable weighing bar 126 may be fastened to the rigid rail 122 to adjust the weight of the bottom part 106. The weighing bar 126 may be concealed with a cover strip 128. For facilitating the attachment of the bottom part 106 to the panel assembly 104, an example of construction may fixedly connect the two panels 116 and 118 with an attachment strip 130, which in turn is fixedly fastened to the bottom part 106.

Referring to FIGS. 1-5, the actuating system 108 can include a reel 132, an actuating module 134 respectively coupled with the operating member 110 and the reel 132, an idler roller 135, a roller 136 and a clutch 138. The reel 132 is pivotally supported inside the head frame 102, and is connected with the panel assembly 104, e.g., with the two panels 116 and 118 of the panel assembly 104. According to an example of construction, an outer circumferential surface of the reel 132 can have two slots 132A at two spaced-apart angular positions, and the two panels 116 and 118 can be respectively attached to two elongate strips 139 that are respectively inserted into the two slots 132A for anchoring the panel assembly 104 with the reel 132. Depending on the direction of rotation of the reel 132, the panel assembly 104 can wind around the reel 132 for retraction toward the head frame 102, or unwind from the reel 132 to expand and lower below the head frame 102. The panel assembly 104 can be wound around the reel 13 with the panel 116 at an inner side and the other panel 118 at an outer side. The panels 116 and 118 can respectively correspond to a front and a rear panel when the window shade 100 is installed in a room, the front panel facing an interior of the room, and the rear panel being behind the front panel.

The reel 132 is pivotally connected with the head frame 102 about a pivot axis P1 that extends along the head frame 102. According to an example of construction, the reel 132 may be disposed inside the head frame 102 with an end 132B of the reel 132 fixedly attached to a coupling plug 140, and the coupling plug 140 in turn is pivotally connected with a shaft portion 112A protruding from the side cap 112 of the head frame 102. The other end 132C of the reel 132 can be rotationally coupled with the actuating module 134, which is assembled adjacent to the other side cap 114 of the head frame 102. The actuating module 134 is operable to drive the reel 132 in rotation about the pivot axis P1 relative to the head frame 102 for winding and unwinding the panel assembly 104.

Figure 6:
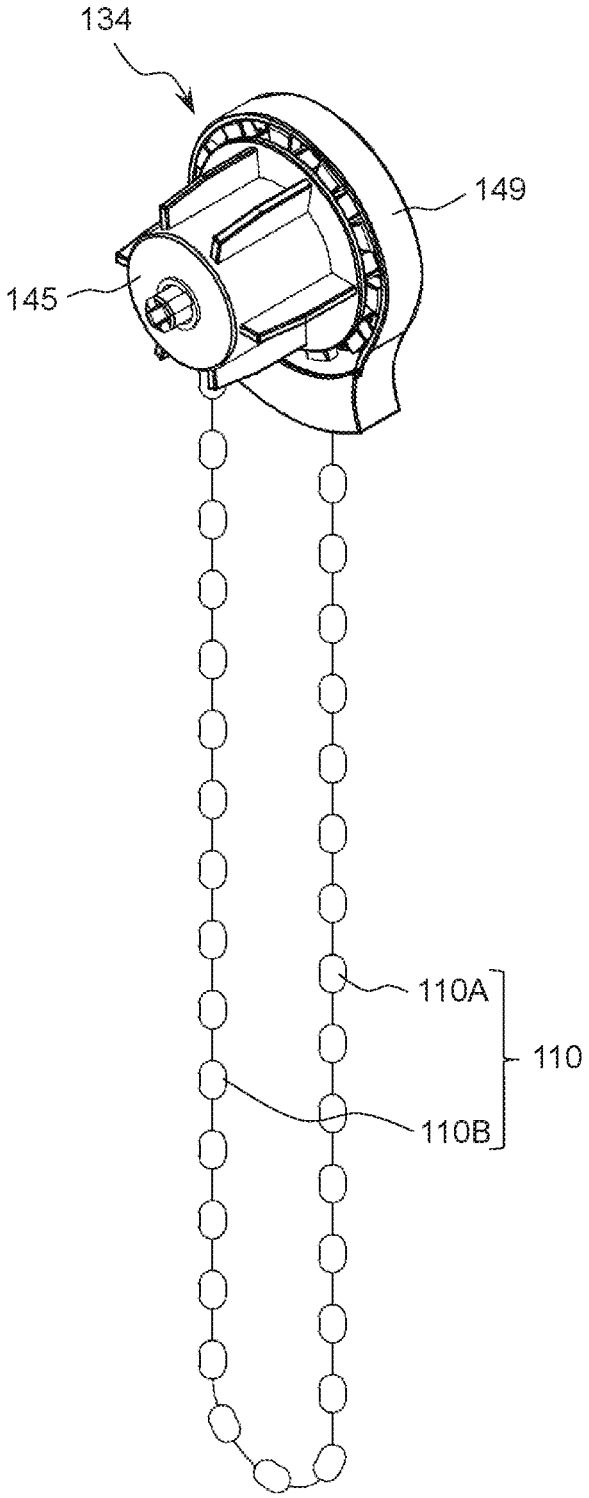
FIG. 6 is a perspective view illustrating an actuating module provided in the window shade.
Figure 7:
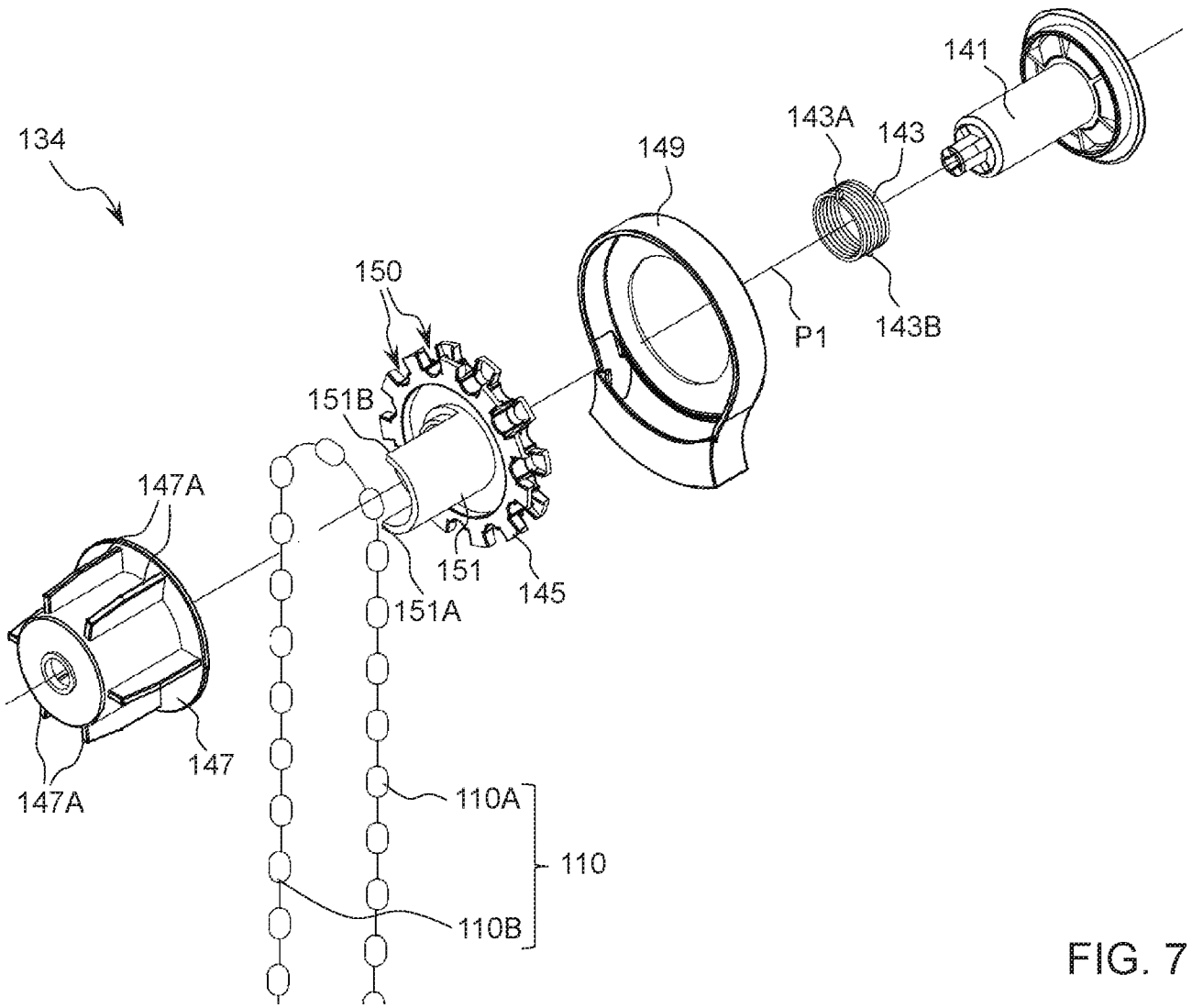
FIG. 7 is an exploded view illustrating a construction of the actuating module.
Figure 8:
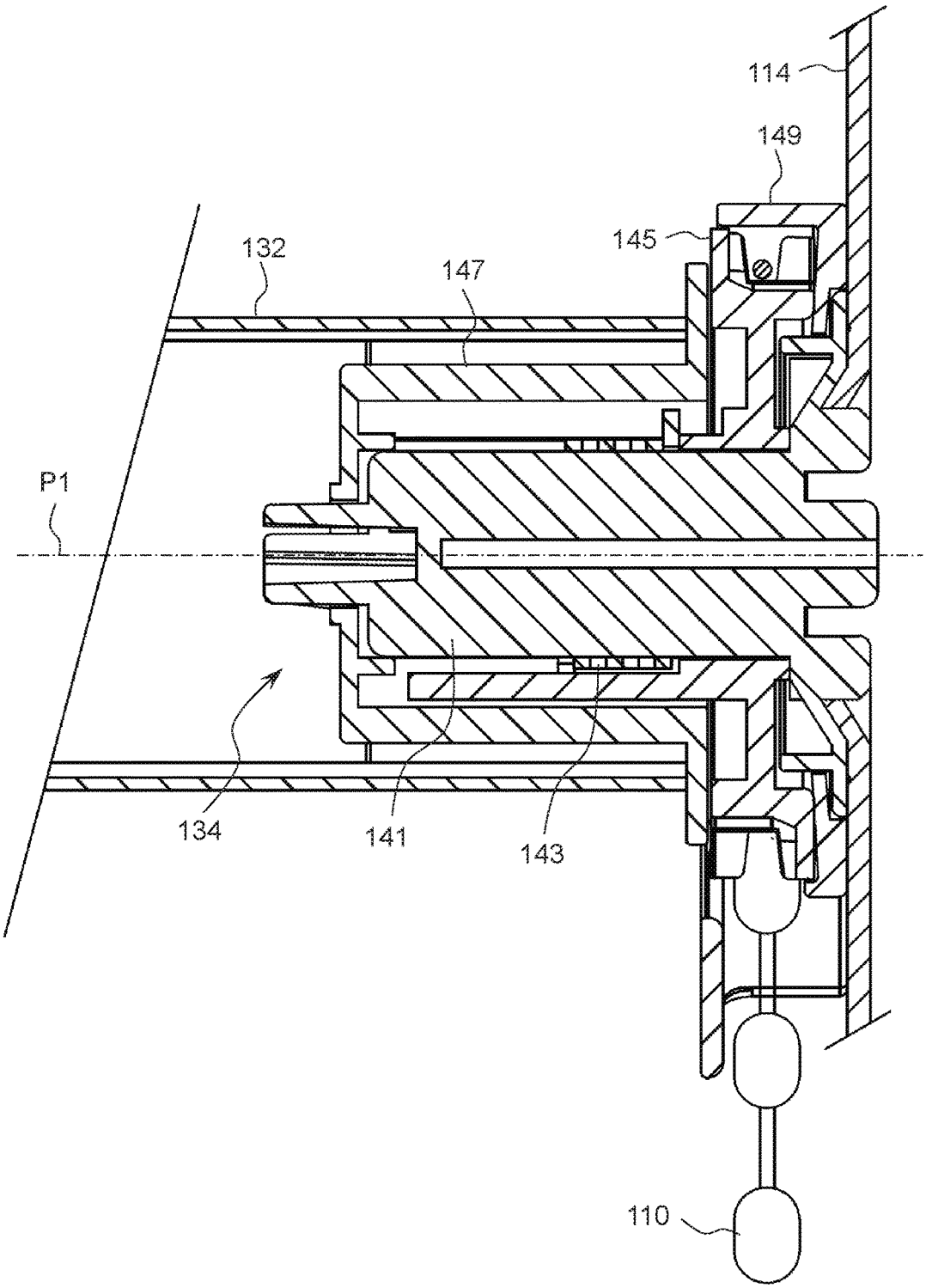
FIGS. 8 and 9 are two cross-sectional views taken in two perpendicular section planes illustrating the assembly of the actuating module.
Figure 9:
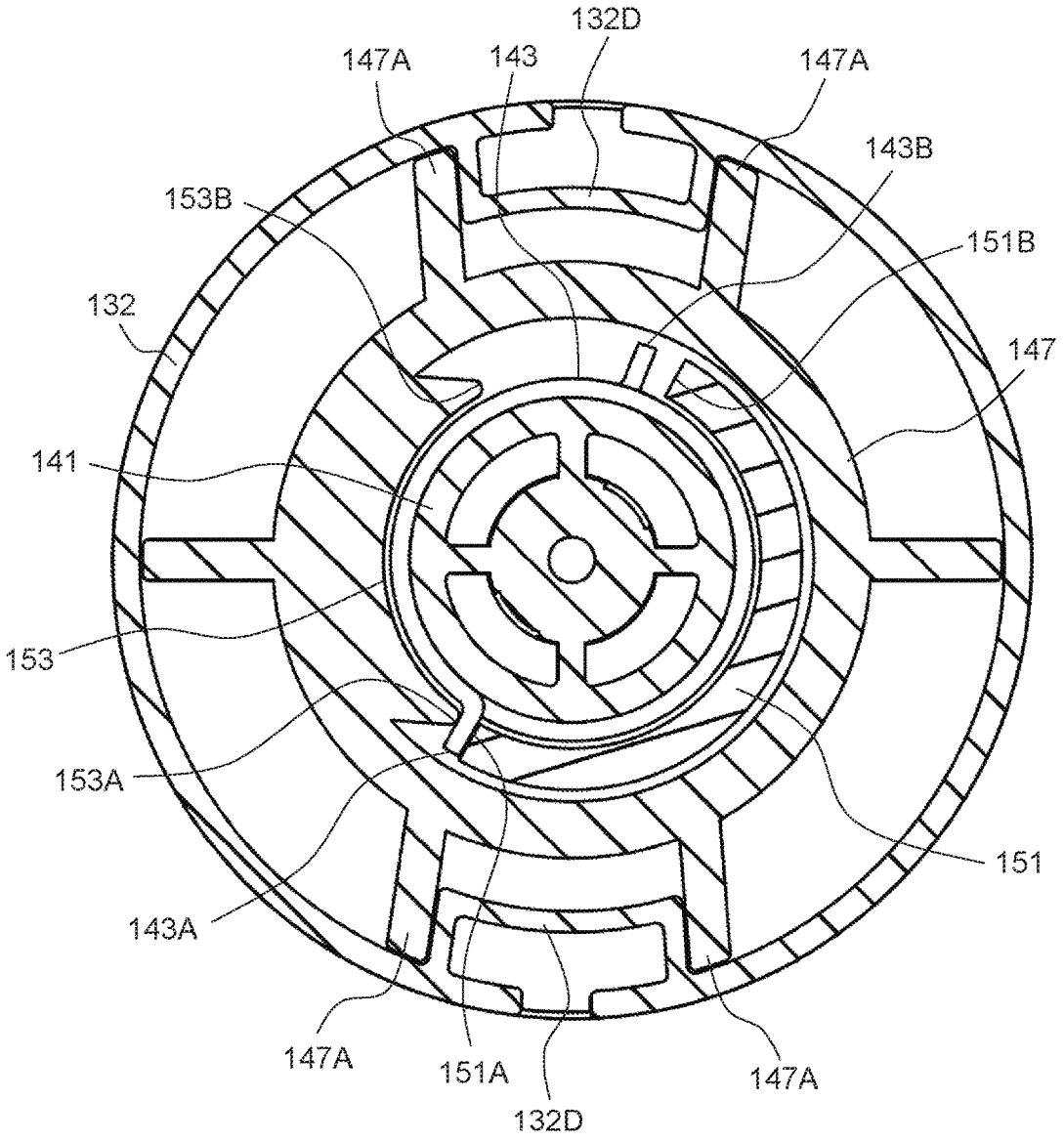

In conjunction with FIG. 5, FIGS. 6 and 7 are respectively a perspective and an exploded view illustrating a construction of the actuating module 134, and FIGS. 8 and 9 are two cross-sectional views taken in two section planes respectively parallel and perpendicular to the pivot axis P1 illustrating the assembly of the actuating module 134. Referring to FIGS. 6-9, the actuating module 134 can include the operating member 110, a fixed shaft 141, a spring 143, a sprocket wheel 145, a reel connector 147 and a casing 149. The fixed shaft 141 can be fixedly attached to the side cap 114 of the head frame 102 coaxial to the pivot axis P1 of the reel 132.

The spring 143 can be a coiled spring. The spring 143 can be assembled around the fixed shaft 141 in tight contact therewith, and can have two prongs 143A and 143B spaced apart from each other. Each of the two prongs 143A and 143B can be respectively pushed in one direction for causing the spring 143 to expand and loosen with respect to the fixed shaft 141, and in an opposite direction for causing the spring 143 to further contract and tighten on the fixed shaft 141.

The sprocket wheel 145 can have a hole through which is disposed the fixed shaft 141 so that the sprocket wheel 145 is pivotally supported by the fixed shaft 141 for rotation about the pivot axis P1. The sprocket wheel 145 may have a circumference configured to engage with the operating member 110. In the illustrated embodiment, the operating member 110 is exemplary a bead chain, and the circumference of the sprocket wheel 145 may include a plurality of notches 150 that can engage with the bead chain. Pulling on the operating member 110 thus can drive the sprocket wheel 145 to rotate in either direction. For example, the operating member 110 may have an inner portion 110A and an outer portion 110B, and pulling downward one of the inner and outer portions 110A and 110B may drive the sprocket wheel 145 to rotate in one direction while pulling downward the other one of the inner and outer portions 110A and 110B may drive the sprocket wheel 145 to rotate in an opposite direction.

The sprocket wheel 145 can further be fixedly connected with an extension 151, which can have an arcuate shape having two opposite edge 151A and 151B that wraps partially around the fixed shaft 141. According to an example of construction, the sprocket wheel 145 and the extension 151 may be provided as a single part. The sprocket wheel 145 can be disposed with the extension 151 extending partially around a first region of the spring 143 such that a rotation of the sprocket wheel 145 in either direction can result in the extension 151 selectively pushing against one of the two prongs 143A and 143B for causing the spring 143 to expand and loosen. For example, the edge 151A of the extension 151 can push against the prong 143A of the spring 143 for causing the spring 143 to loosen when the sprocket wheel 145 rotates in a first direction, and the edge 151B of the extension 151 can push against the prong 143B of the spring 143 for causing the spring 143 to loosen when the sprocket wheel 145 rotates in a second direction opposite to the first direction.

Referring again to FIGS. 6-9, the reel connector 147 can be rotationally coupled with the reel 132, and can have an opening through which is disposed the fixed shaft 141 so that the reel connector 147 is pivotally supported by the fixed shaft 141 for rotation about the pivot axis P1. According to an example of construction, the reel connector 147 can be provided as a plug which may be inserted into the reel 132, an outer surface of the reel connector 147 being provided with a plurality of teeth 147A that may be engaged with inner teeth 132D provided inside the reel 132 for rotationally coupling the reel connector 147 with the reel 132. The reel connector 147 and the reel 132 thus can rotate in unison for winding and unwinding the panel assembly 104.

As better shown in FIG. 9, the reel connector 147 can further have an inner side provided with a rib 153 having two opposite edges 153A and 153B. According to an example of construction, the rib 153 can be formed integrally with the reel connector 147. The reel connector 147 can be disposed with the rib 153 extending partially around a second region of the spring 143 and capable of selectively pushing against either of the two prongs 143A and 143B for causing the spring 143 to contract and tighten on the fixed shaft 141.

Referring again to FIGS. 6-9, the casing 149 can be affixed with the head frame 102, and can enclose at least partially the sprocket wheel 145 with the operating member 110 extending outside the casing 149 and the head frame 102.

For lowering the panel assembly 104, a user can pull downward one of the inner portion 110A and the outer portion 110B of the operating member 110 (e.g., the outer portion 110B), which urges the sprocket wheel 145 to rotate in a first direction and cause the extension 151 to push against one of the two prongs 143A and 143B for causing the spring 143 to expand and loosen. For example, as schematically shown in FIG. 9, the edge 151A of the extension 151 may contact and push against the prong 143A of the spring 143 to cause the spring 143 to expand and loosen when the outer portion 110B of the operating member 110 is pulled downward. As the edge 151A of the extension 151 pushes against the prong 143A of the spring 143, the other edge 151B of the extension 151 moves away from the other prong 143B of the spring 143. The loosened spring 143 then can rotate along with the sprocket wheel 145 and push against the rib 153 of the reel connector 147, e.g., via a contact between the prong 143A of the spring 143 and the edge 153A of the rib 153, which consequently causes the reel connector 147 and the reel 132 to rotate in unison in the same direction along with the spring 143 and the sprocket wheel 145 for unwinding and lowering the panel assembly 104. During this unwinding rotation, the prong 143B of the spring 143 may remain out of contact with the edge 151B of the extension 151 and the edge 153B of the rib 153.

Figure 10:
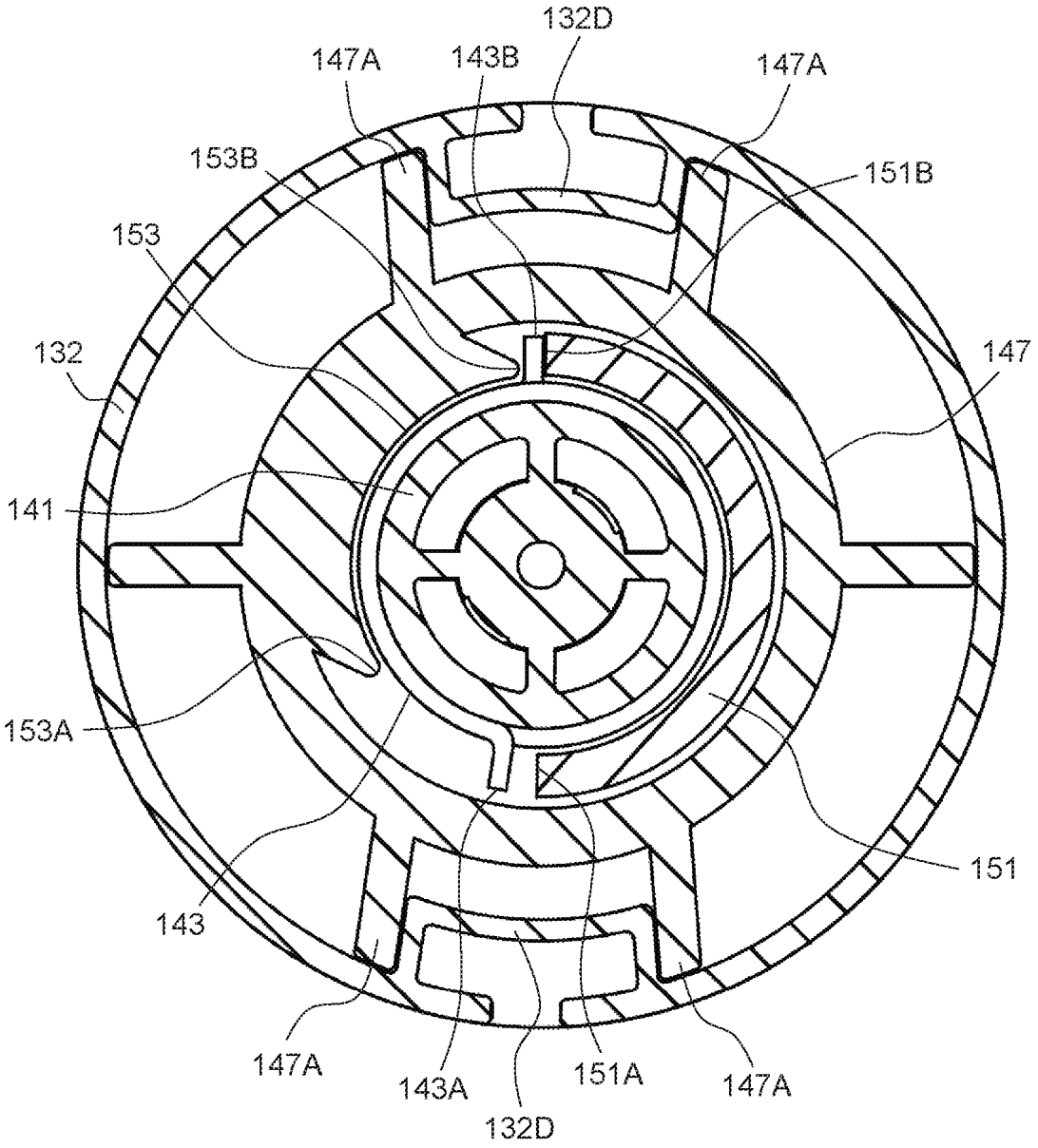
FIG. 10 is a cross-sectional view taken in a section plane similar to that of FIG. 9 illustrating the actuating module in another configuration of operation.
Figure 11:
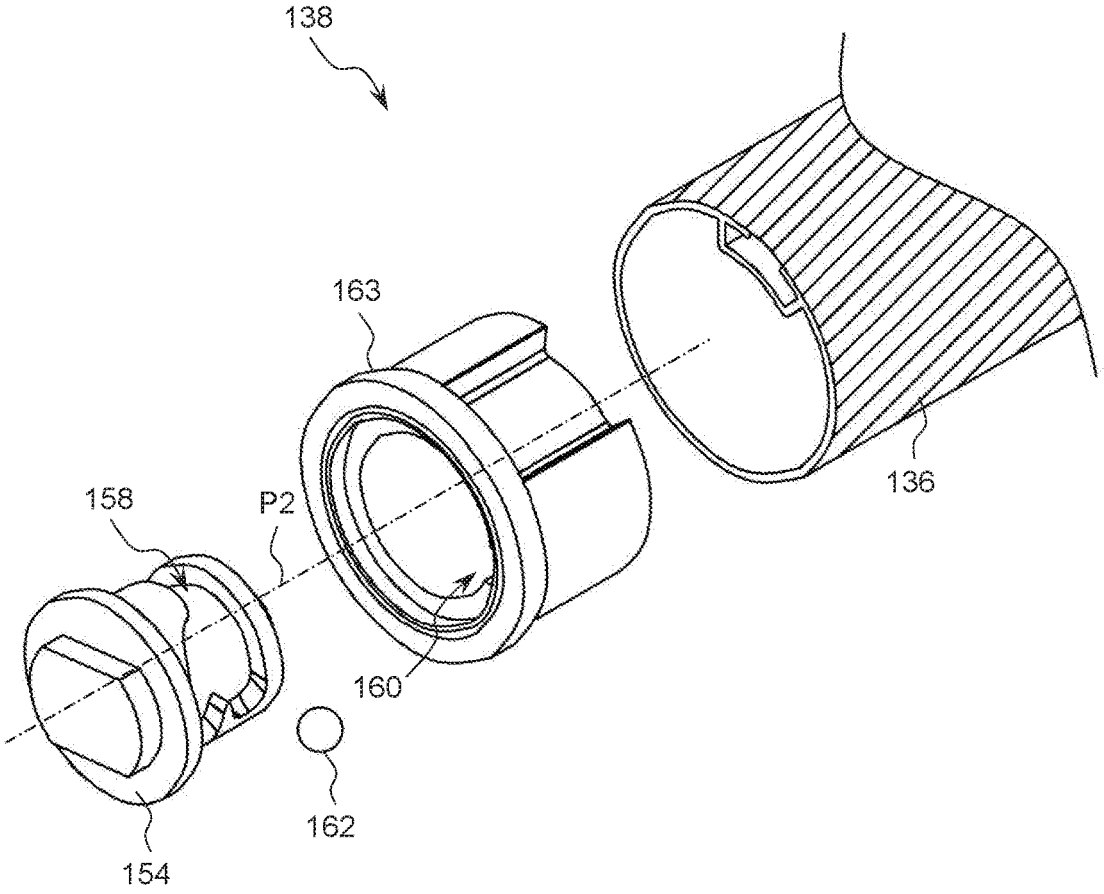
FIG. 11 is an exploded view illustrating some construction details of a clutch provided in the actuating system of the window shade.
Figure 12:
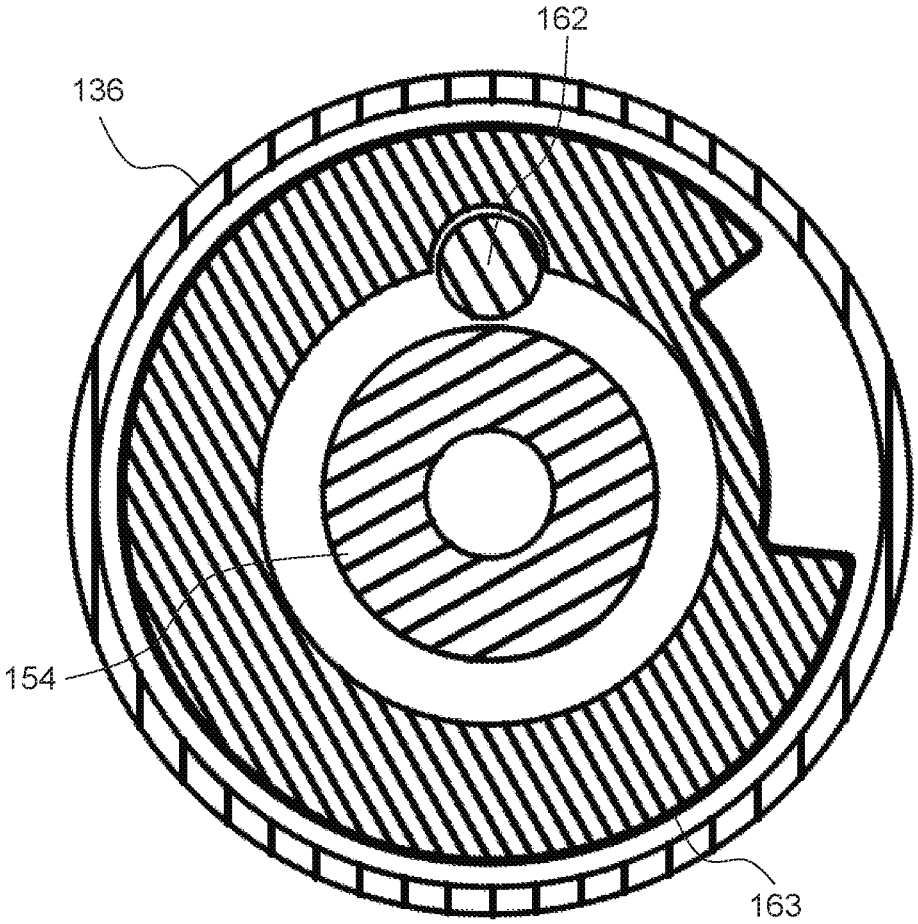
FIG. 12 is a cross-sectional view illustrating some construction details of the clutch.

For raising the panel assembly 104, a user can pull downward the other one of the inner portion 110A and the outer portion 110B of the operating member 110 (e.g., the inner portion 110A), which urges the sprocket wheel 145 to rotate in an opposite second direction and cause the extension 151 to push against the other one of the two prongs 143A and 143B for causing the spring 143 to expand and loosen. For example, as schematically shown in FIG. 10, the edge 151B of the extension 151 may contact and push against the prong 143B of the spring 143 to cause the spring 143 to expand and loosen when the inner portion 110A of the operating member 110 is pulled downward. As the edge 151B of the extension 151 pushes against the prong 143B of the spring 143, the other edge 151A of the extension 151 moves away from the other prong 143A of the spring 143. The loosened spring 143 then can likewise rotate along with the sprocket wheel 145 and push against the rib 153, e.g., via a contact between the prong 143B of the spring 143 and the edge 153B of the rib 153, which consequently causes the reel connector 147 and the reel 132 to rotate in unison in the same direction along with the spring 143 and the sprocket wheel 145 for winding and raising the panel assembly 104. During this winding rotation, the prong 143A of the spring 143 may remain out of contact with the edge 151A of the extension 151 and the edge 153A of the rib 153.

When the operating member 110 is not operated and the sprocket wheel 145 remains stationary (e.g., when the panel assembly 104 is positioned at a desired height), the suspended weight of the panel assembly 104 and the bottom part 106 can apply a torque on the reel 132 and the reel connector 147, which biases the rib 153 to push against one of the two prongs 143A and 143B of the spring 143 for causing the spring 143 to contract and tighten on the fixed shaft 141. While the rib 153 remains in contact against one of the two prongs 143A and 143B, the tightening action of the spring 143 on the fixed shaft 141 can block rotation of the spring 143, the reel connector 147 and the reel 132 about the pivot axis P1 and keep the panel assembly 104 and the bottom part 106 at any desirable positions, such as the different positions shown in FIGS. 1-3.

Referring again to FIGS. 4 and 5, the idler roller 135 and the roller 136 of the actuating system 108 is disposed inside the head frame 102 at two distinct positions spaced apart from the reel 132. In the illustrated embodiment of FIGS. 4 and 5, the roller 136 is exemplary disposed below the reel 132, and may have a diameter smaller than the diameter of the reel 132. The roller 136 can be pivotally assembled with the head frame 102 about a pivot axis P2 that is vertically below and parallel to the pivot axis P1 of the reel 132. For example, one end of the roller 136 can be pivotally connected with a fixed shaft portion 154 fixedly attached to the side cap 114 of the head frame 102, and another opposite end of the roller 136 can be pivotally connected with a shaft portion 112B protruding from the side cap 112 via a coupling plug 155. Moreover, the roller 136 can have an outer surface that is covered at least partially with a friction portion 156. The friction portion 156 may be made of a material that can promote friction between the roller 136 and the panel assembly 104, in particular between the roller 136 and the panel 116 of the panel assembly 104. Examples of suitable materials for the friction portion 156 may include, without limitation, rubber. The friction portion 156 may be a sleeve or a pad that can cover at least partially the roller 136.

The idler roller 135 is disposed at an intermediate position between the reel 132 and the roller 136, and can have a diameter smaller than the diameter of the roller 136. The idler roller 135 can be provided to suitably tension the panel assembly 104, and can freely rotate about a pivot axis P3 as the panel assembly 104 travels to wind around the reel 132 or unwind from the reel 132. For example, the idler roller 135 can be respectively connected pivotally with the two side caps 112 and 114 via two coupling plugs 157A and 157B.

The unwound portion of the panel assembly 104 can wrap partially around the idler roller 135 with the panel 118 in contact with the idler roller 135, and then wrap at least partially around the roller 136 with the panel 116 in contact with the roller 136. While the reel 132 rotates for winding and unwinding the panel assembly 104, the panel 118 can remain in contact with the idler roller 135 in a region between the reel 132 and the roller 136, and the panel 116 can remain in contact with the roller 136.

In conjunction with FIG. 5, FIGS. 11-13 are respectively an exploded view, a cross-sectional view and a planar projection view illustrating construction details of the clutch 138 provided in the actuating system 108. Referring to FIGS. 5 and 11-13, the clutch 138 is operatively connected with the roller 136. According to an example of construction, the clutch 138 can be disposed inside the roller 136 and can include a guide track 158 provided on the fixed shaft portion 154, a guide slot 160 provided inside the roller 136, and a running member 162 received at least partially in the guide track 158 and the guide slot 160.

The guide track 158 can be a groove provided on an outer surface of the fixed shaft portion 154, and can include a closed-loop portion 158A running circumferentially around the fixed shaft portion 154, and one or more stop portion 158B connected with the closed-loop portion 158A. According to an example of construction, the closed-loop portion 158A can have a plurality of turns TR and TL alternately turning in opposite directions (e.g., one turn TR turning right and the next turn TL turning left), and each stop portion 158B can be a recess positioned between two consecutive turns TR and TL.

The guide slot 160 can have a rectilinear shape extending generally parallel alongside the pivot axis P2 defined by the fixed shaft portion 154, and can overlap at least partially with the guide track 158. According to an example of construction, the roller 136 may be fixedly connected with a collar 163, and the guide slot 160 may be formed on an inner side of the collar 163. Accordingly, the guide slot 160 can rotate along with the roller 136 in either direction.

The running member 162 can be a ball received at least partially in the guide track 158 and the guide slot 160, and can be guided for sliding movement along the guide slot 160 and the guide track 158.

Depending on the direction of rotation of the reel 132, the clutch 138 described herein can selectively block or allow rotation of the roller 136 so that the rotational displacement of the reel 132 can cause the panel 118 to slide relative to the panel 116 for switching the panel assembly 104 between the closed state and the open state. More specifically, the clutch 138 has an engaged state where the running member 162 is engaged with one stop portion 158B so that the clutch 138 can prevent the roller 136 from rotating in a first direction R1, and a disengaged state where the running member 162 is disengaged from the stop portions 158B so as to allow rotation of the roller 136 in a second direction R2 opposite to the first direction R1. The clutch 138 is switchable from the disengaged state to the engaged state in response to a rotation of the reel 132 in the unwinding direction, and from the engaged state to the disengaged state in response to a rotation of the reel 132 in a winding direction.

Figure 13:
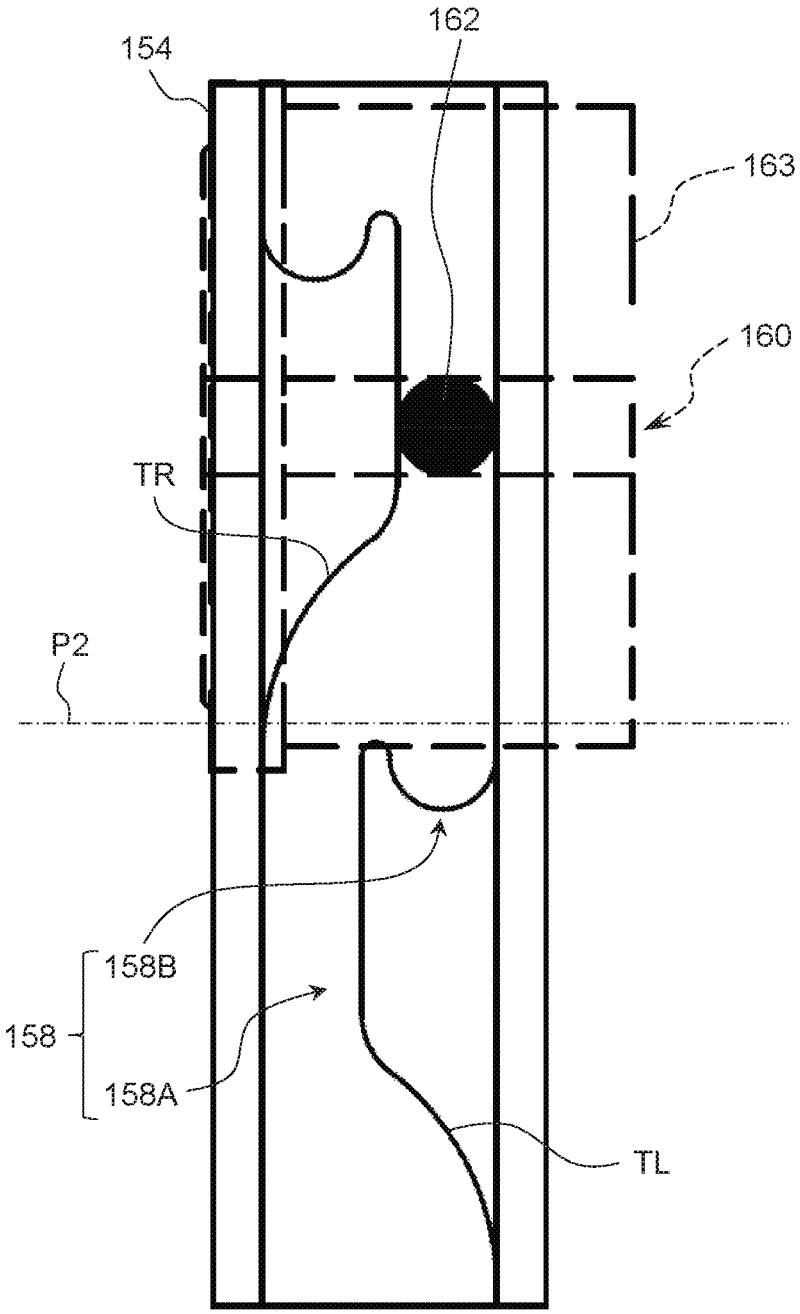
FIG. 13 is a planar projection view illustrating some construction details of the clutch.
Figure 14:
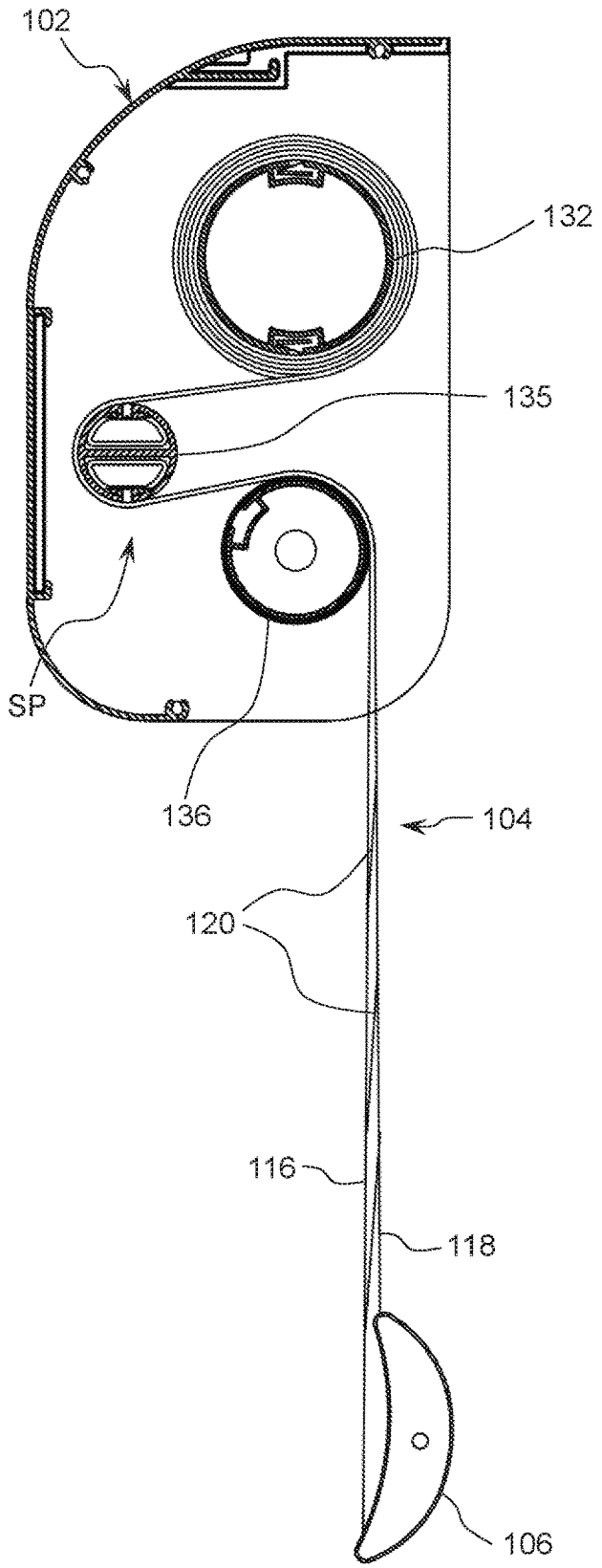
FIG. 14 is a side view illustrating the panel assembly of the window shade in a lowered and closed state.

Reference is made hereinafter to FIGS. 14-20 in conjunction with FIGS. 1-5 and 11-13 to describe exemplary operation for switching the panel assembly 104 of the window shade 100 between the closed state and the open state. In FIG. 14, the panel assembly 104 of the window shade 100 is shown in a lowered and closed state with the bottom part 106 lowered at a distance below the head frame 102 and the transversal vanes 120 turned substantially vertically and overlapping one another for blocking light passage. While the panel assembly 104 is in the closed state, the clutch 138 is in the disengaged state with the running member 162 disengaged from the stop portion 158B and positioned in the closed-loop portion 158A of the guide track 158 on the fixed shaft portion 154, as shown in FIG. 13.

Figure 15:
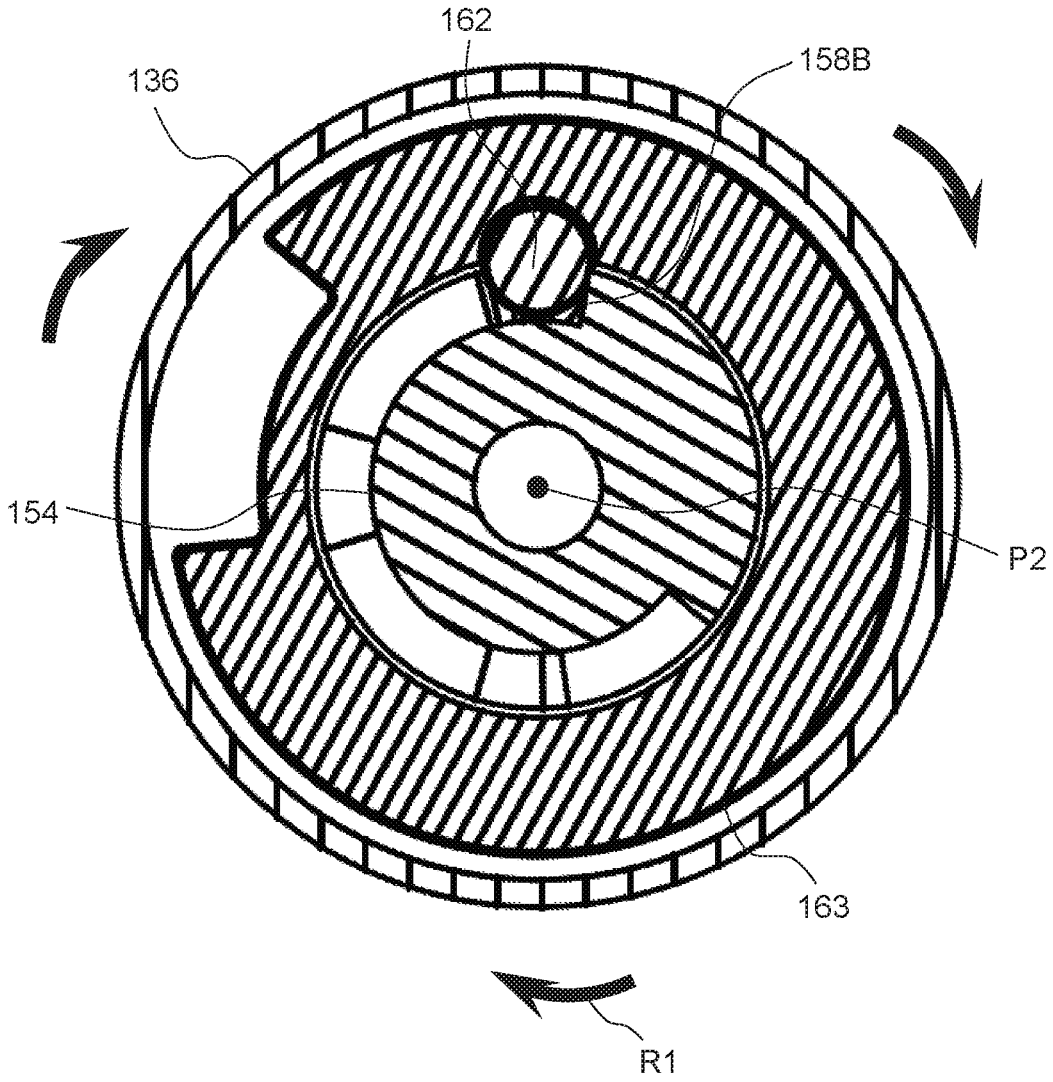
FIG. 15 is a cross-sectional view illustrating the clutch switched to an engaged state for opening the panel assembly.
Figure 16:
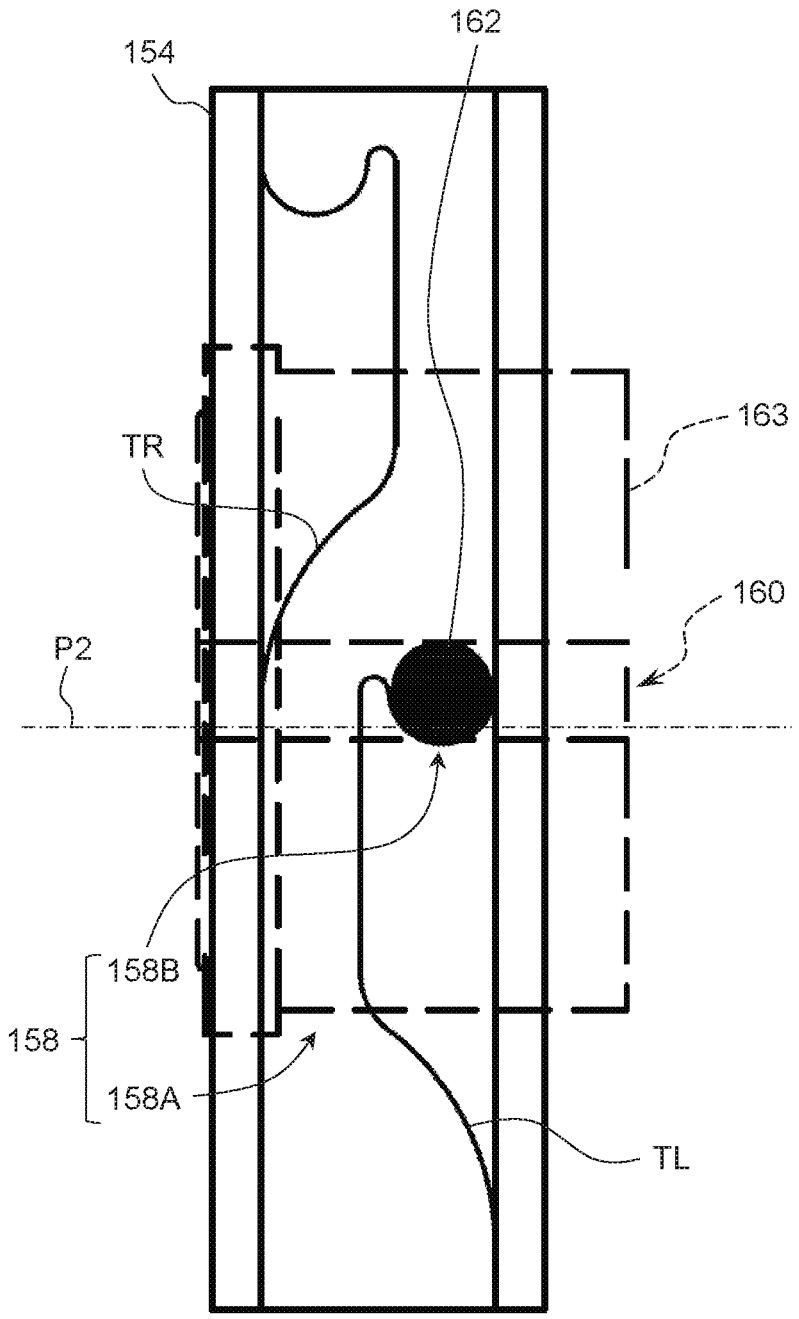
FIG. 16 is a planar projection view illustrating the clutch switched to the engaged state.
Figure 17:
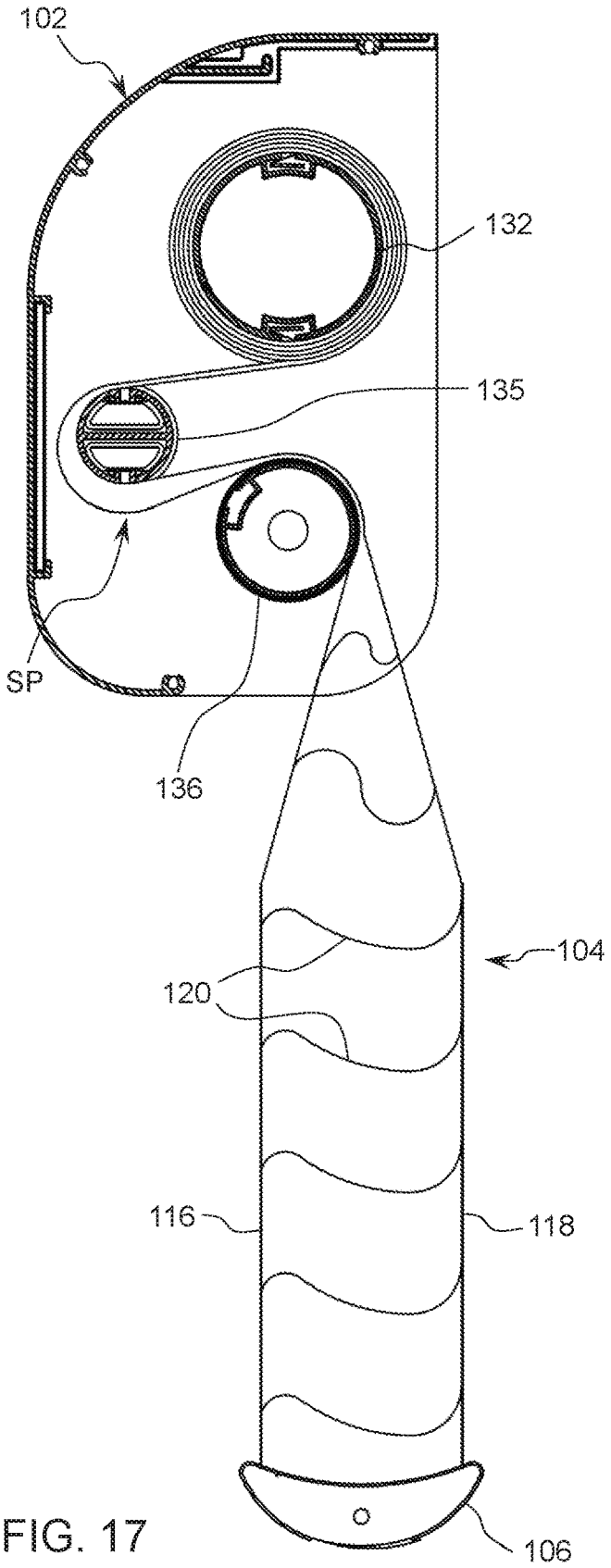
FIG. 17 is a side view illustrating the panel assembly of the window shade in a lowered and open state.

For switching the panel assembly 104 from the closed state to the open state, a user can apply a pulling action on the operating member 110 (e.g., pulling its outer portion 110B downward) so that the reel 132 is driven in rotation in the unwinding direction. As a result, the panel assembly 104 moves and causes the idler roller 135 and the roller 136 to rotate in opposite directions. As shown in FIGS. 15 and 16, this movement of the panel assembly 104 can urge the roller 136 to rotate in the direction R1 so as to bring the running member 162 in engagement with the stop portion 158B. The clutch 138 can be thereby switched from the disengaged state to the engaged state, which can prevent further rotation of the roller 136 in the direction R1. As the reel 132 further rotates in the unwinding direction driven by the operating member 110, the idler roller 135 rotates while the roller 136 is kept stationary by the clutch 138 remaining in the engaged state. Owing to the frictional contact between the panel 116 and the roller 136 (in particular between the panel 116 and the friction portion 156 of the roller 136), the lowering displacement of the panel 116 is impeded by the roller 136 remaining stationary, whereas the panel 118 not in contact with the roller 136 is subjected to less frictional resistance than the panel 116 and can move downward at a faster speed. As shown in FIG. 17, this differential movement between the two panels 116 and 118 can create a slack SP of the panel 116 in a region between the idler roller 135 and the roller 136 and turn the transversal vanes 120 and the bottom part 106 generally horizontally for opening the panel assembly 104. The panel assembly 104 can be thereby switched from the closed state to the open state.

After the panel assembly 104 is switched to the open state, further pulling the outer portion 110B of the operating member 110 downward can drive the reel 132 to rotate in the unwinding direction. As a result, the panel assembly 104 can be lowered while remaining in the open state.

Figure 18:
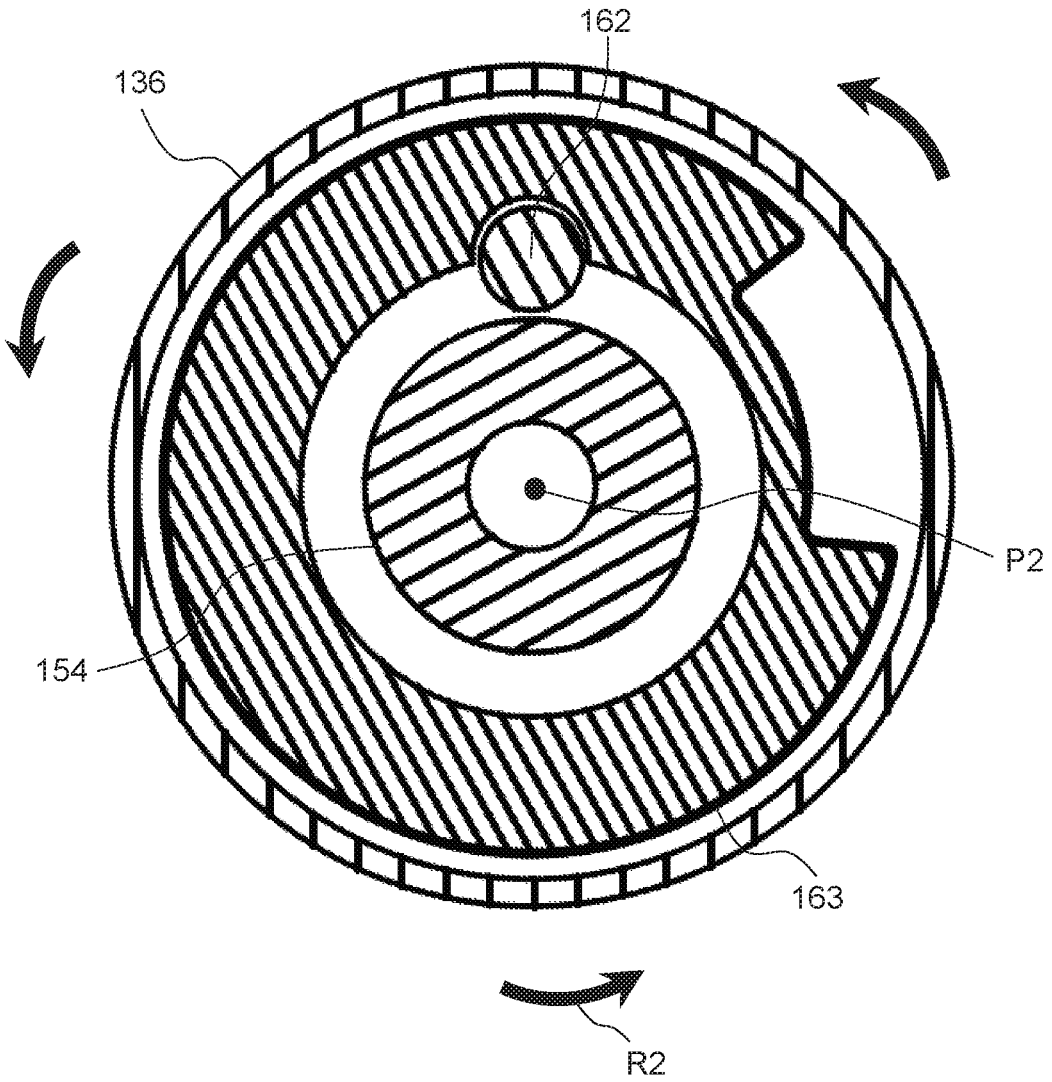
FIG. 18 is a cross-sectional view illustrating the clutch switched to a disengaged state for closing the panel assembly.
Figure 19:
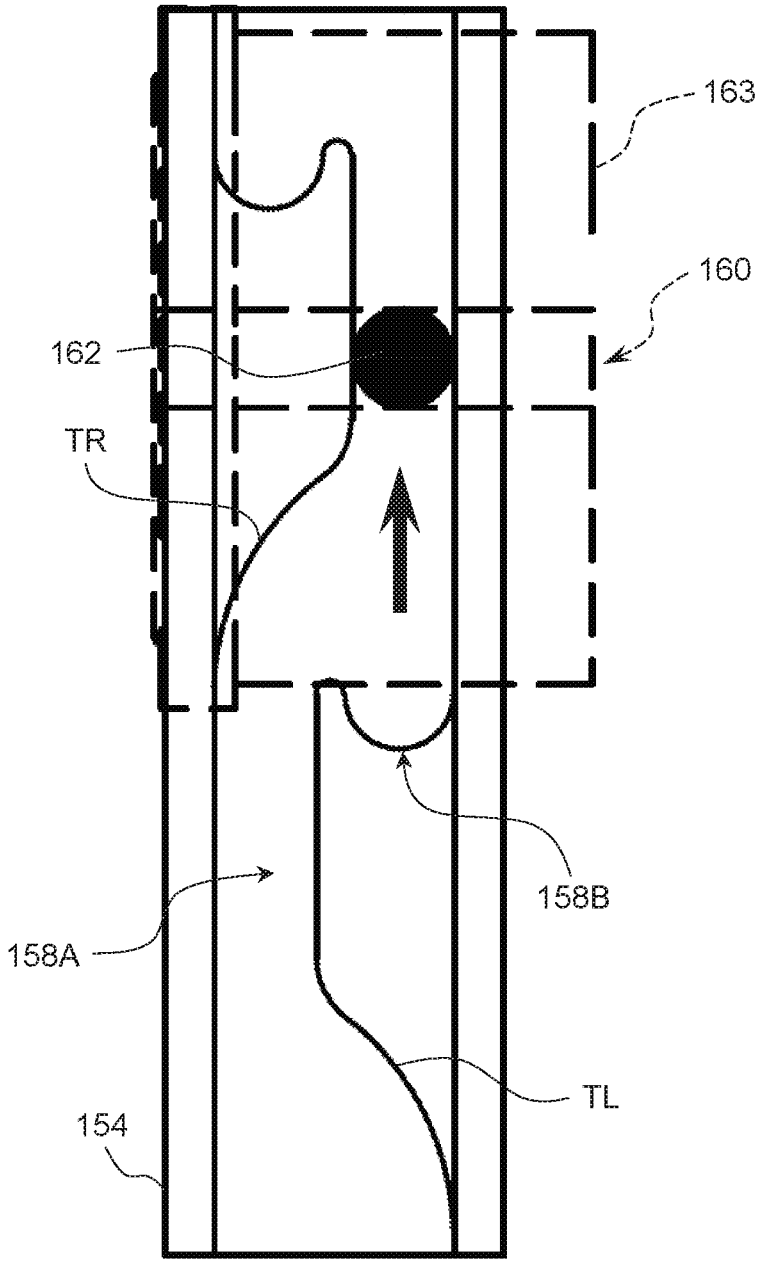
FIG. 19 is a planar projection view illustrating the clutch switched to the disengaged state.
Figure 20:
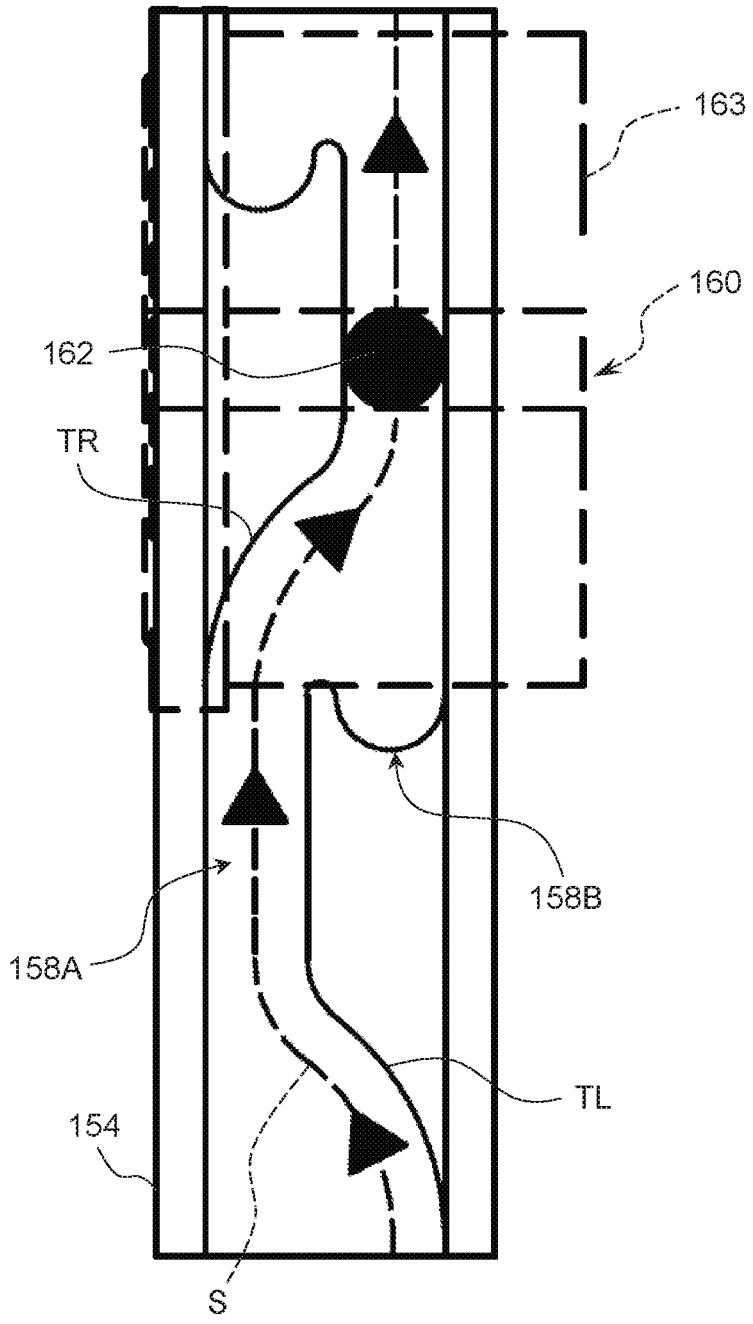
FIG. 20 is a planar projection view illustrating the clutch when the panel assembly is continuously raised upward.

For switching the panel assembly 104 from the open state to the closed state, a user can apply a pulling action on the operating member 110 (e.g., pulling its inner portion 110A downward) so that the reel 132 is driven in rotation in the winding direction. As a result, the panel assembly 104 moves and causes the idler roller 135 and the roller 136 to rotate in opposite directions. As illustrated in FIGS. 18 and 19, this movement of the panel assembly 104 can urge the roller 136 to rotate in the direction R2 opposite to the direction R1 so that the running member 162 can disengage from the stop portion 158B and enter the closed-loop portion 158A of the guide track 158. The clutch 138 can be thereby switched from the engaged state to the disengaged state, which allows rotation of the roller 136 in the direction R2. As the reel 132 rotates in the winding direction, the panel 118 can slide relative to the panel 116 so as to reduce the slack of the panel 116 and turn the transversal vanes 120 and the bottom part 106 substantially vertically, the transversal vanes 120 thereby vertically overlapping one another for closing the panel assembly 104.

After the panel assembly 104 is switched to the closed state, further pulling the inner portion 110A of the operating member 110 downward can drive the reel 132 to rotate in the winding direction. As a result, the panel assembly 104 can be raised and wound around the reel 132 while remaining in the closed state. While the reel 132 further rotates for winding the panel assembly 104, the clutch 138 can remain in the disengage state and the roller 136 can continuously rotate in the direction R2 around the fixed shaft portion 154, the running member 162 continuously sliding along the closed-loop portion 158A of the guide track 158 as shown by arrow S in FIG. 20.

Figure 21:
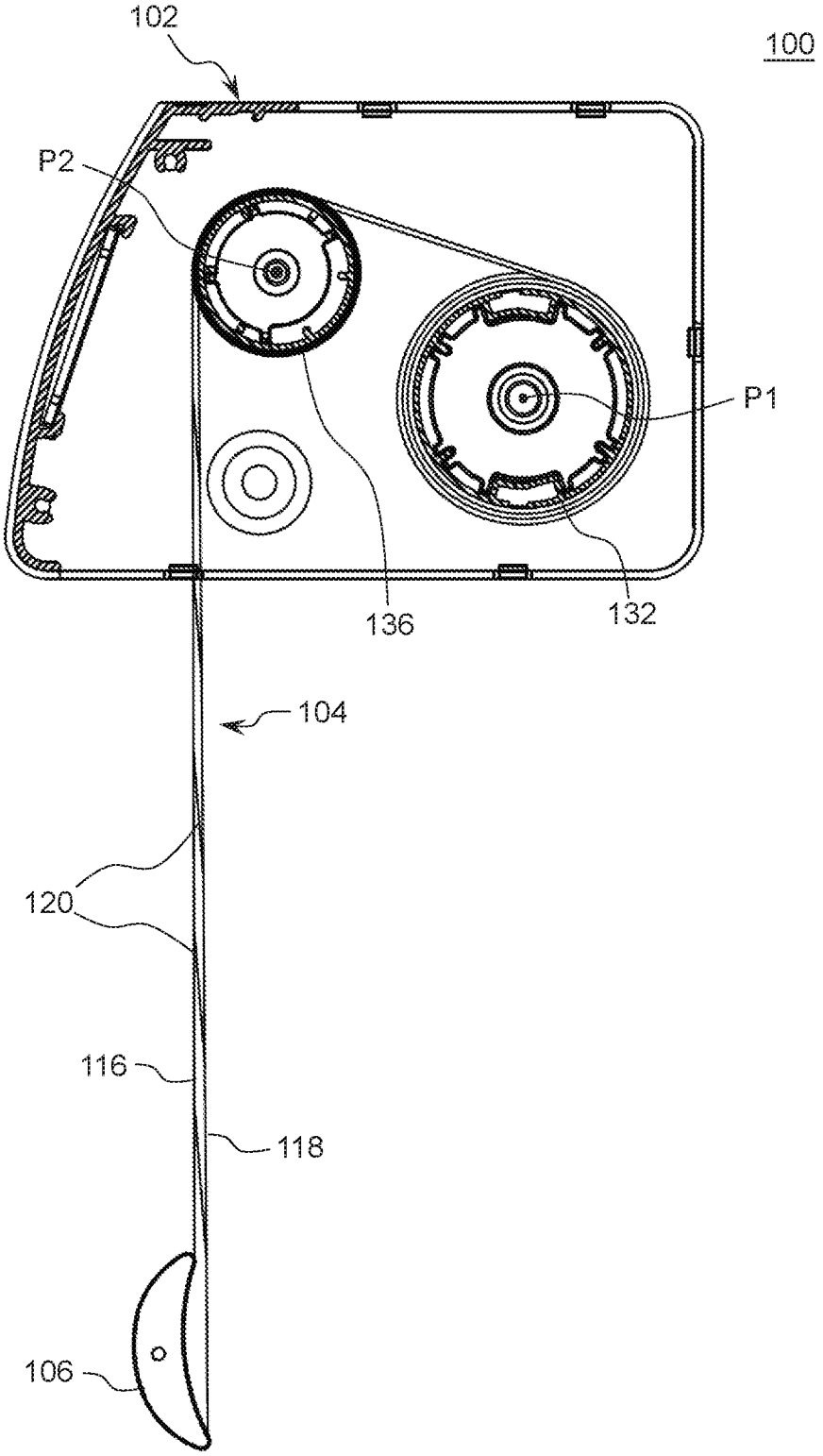
FIGS. 21 and 22 are schematic views illustrating a variant construction of the window shade respectively in a lowered and closed state and a lowered and open state.
Figure 22:
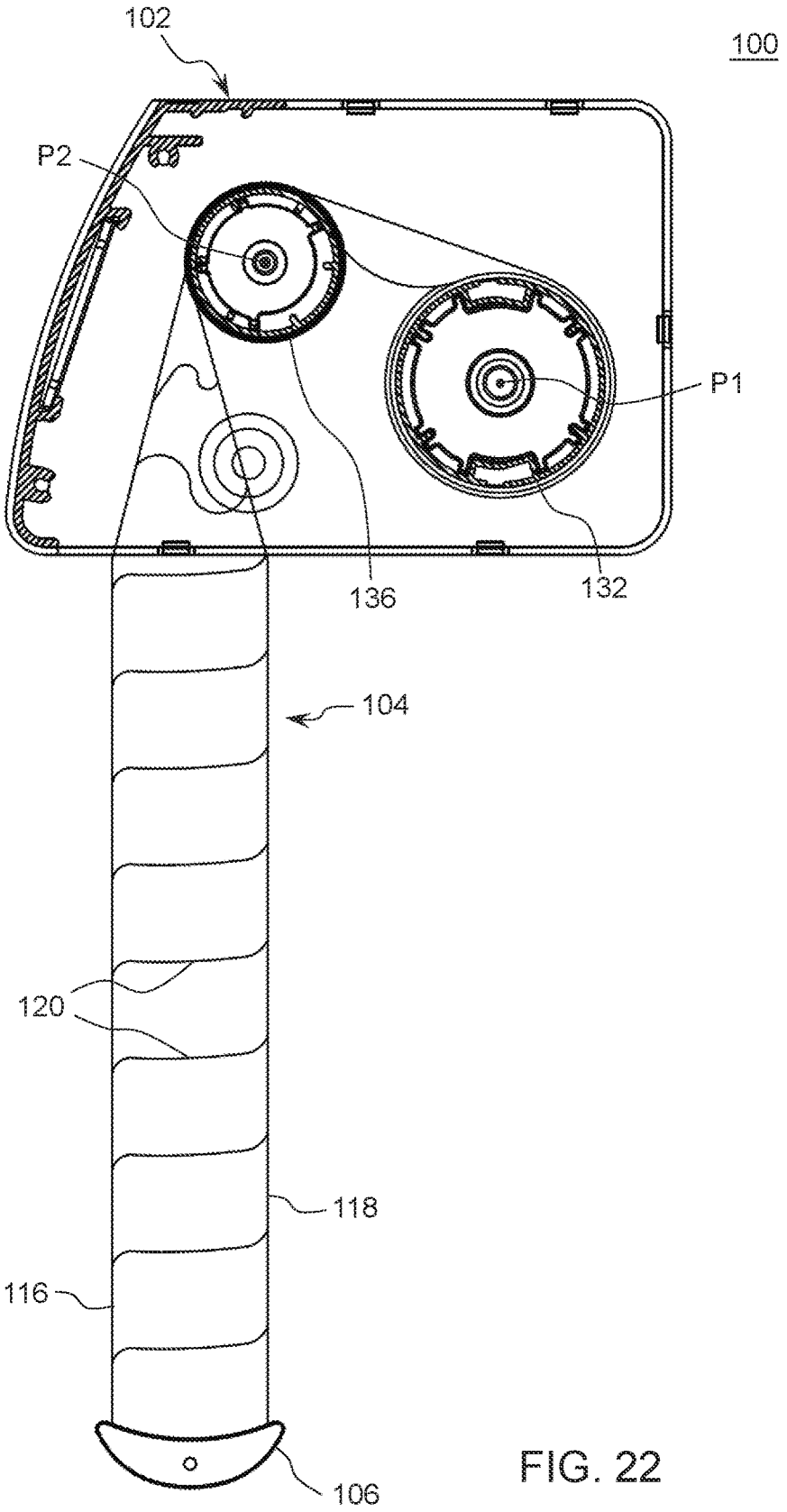

FIGS. 21 and 22 are schematic views illustrating a variant construction of the window shade 100 in which the idler roller 135 may be omitted, and the roller 136 may be pivotally connected with the head frame 102 about a pivot axis P2 that is located vertically higher than the pivot axis P1 of the reel 132. Otherwise, the actuating system used in the window shade 100 shown in FIGS. 21 and 22 may be similar to the actuating system 108 described previously, FIG. 21 showing the window shade in a lowered and closed state, and FIG. 22 showing the window shade 100 in a lowered and open state.

Advantages of the window shades described herein include a relatively simple construction that offers the ability to adjust a vertical position of the panel assembly and close and open the panel assembly at any desired height. The vertical displacement of the panel assembly and its switching between the closed and open state can be driven by a rotation of the reel around which is wound the panel assembly, which allows the use of a single operating member to control the window shade. As a result, the window shade can be more convenient to operate for a user.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a head frame;

a reel pivotally connected with the head frame and rotatable about a first pivot axis;

a roller disposed at a position spaced apart from the reel and pivotally connected with the head frame about a second pivot axis;

a panel assembly connected with the reel and including a first and a second panel, and a plurality of transversal vanes that are respectively connected with the first and second panels, the reel being rotatable to wind and unwind the panel assembly with the first panel remaining in contact with the roller, and the panel assembly being switchable between an open state for light passage and a closed state blocking light passage by rotating the transversal vanes; and a clutch operatively connected with the roller, the clutch being disposed inside the roller, the clutch being switchable between an engaged state preventing the roller from rotating in a first direction, and a disengaged state for rotation of the roller in a second direction opposite to the first direction, wherein the reel is rotatable in an unwinding direction while the roller is kept stationary by the clutch in the engaged state for switching the panel assembly from the closed state to the open state.

2. The window shade according to claim 1, wherein the first panel is in contact with a friction portion provided on the roller while the panel assembly switches from the closed state to the open state.

3. The window shade according to claim 1, wherein the clutch is switchable from the disengaged state to the engaged state in response to a rotation of the reel in the unwinding direction, and from the engaged state to the disengaged state in response to a rotation of the reel in a winding direction.

4. The window shade according to claim 3, wherein the clutch remains in the engaged state while the reel continuously rotates for unwinding the panel assembly, and in the disengaged state while the reel continuously rotates for winding the panel assembly, the roller being rotatable in the second direction while the reel rotates for winding the panel assembly.

5. The window shade according to claim 1, wherein the panel assembly is switchable from the open state to the closed state in response to a rotation of the reel in a winding direction.

6. The window shade according to claim 5, wherein the panel assembly is switched from the open state to the closed state with the roller rotating in the second direction and the clutch in the disengaged state.

7. The window shade according to claim 1, wherein the panel assembly remains in the closed state as the reel continuously rotates for winding the panel assembly, and the panel assembly remains in the open state as the reel continuously rotates for unwinding the panel assembly.

8. The window shade according to claim 1, further including an idler roller in contact with a portion of the panel assembly between the reel and the roller.

9. The window shade according to claim 1, wherein the second pivot axis is located vertically lower or higher than the first pivot axis.

10. The window shade according to claim 1, wherein the panel assembly is wound around the reel with the first panel at an inner side and the second panel at an outer side.

11. The window shade according to claim 1, wherein the roller is pivotally assembled about a fixed shaft portion attached to the head frame, and the clutch includes:

a guide track provided on the fixed shaft portion, the guide track including a closed-loop portion running circumferentially around the fixed shaft portion, and a stop portion connected with the closed-loop portion;

a guide slot provided inside the roller and overlapping partially with the guide track; and a running member guided for movement along the guide slot and the guide track, wherein the running member is engaged with the stop portion when the clutch is in the engaged state.

12. The window shade according to claim 11, wherein the roller rotates around the fixed shaft portion and the running member moves along the closed-loop portion when the reel rotates for winding the panel assembly.

13. The window shade according to claim 1, further including an actuating module coupled with the reel, the actuating module including a bead chain operable to drive the reel in rotation for winding and unwinding the panel assembly.

14. A window shade comprising:

a head frame;

a reel pivotally connected with the head frame and rotatable about a first pivot axis;

a roller disposed at a position spaced apart from the reel and pivotally connected with the head frame about a second pivot axis, the roller being pivotally assembled about a fixed shaft portion attached to the head frame;

a panel assembly connected with the reel and including a first and a second panel, and a plurality of transversal vanes that are respectively connected with the first and second panels, the reel being rotatable to wind and unwind the panel assembly with the first panel remaining in contact with the roller, and the panel assembly being switchable between an open state for light passage and a closed state blocking light passage by rotating the transversal vanes; and a clutch operatively connected with the roller, the clutch being switchable between an engaged state preventing the roller from rotating in a first direction, and a disengaged state for rotation of the roller in a second direction opposite to the first direction, wherein the reel is rotatable in an unwinding direction while the roller is kept stationary by the clutch in the engaged state for switching the panel assembly from the closed state to the open state;

wherein the clutch includes a guide track provided on the fixed shaft portion, a guide slot provided inside the roller and overlapping partially with the guide track, and a running member guided for movement along the guide slot and the guide track, the guide track including a closed-loop portion and a stop portion connected with each other, the closed-loop portion running circumferentially around the fixed shaft portion, and the running member being engaged with the stop portion when the clutch is in the engaged state.

15. A window shade comprising:

a head frame;

a reel pivotally connected with the head frame and rotatable about a first pivot axis;

a roller pivotally connected with the head frame at a position spaced apart from the reel, the roller being rotatable about a second pivot axis;

a panel assembly connected with the reel and including a first and a second panel, and a plurality of transversal vanes that are respectively connected with the first and second panels, the first panel being disposed in contact with the roller, and the panel assembly being switchable between an open state for light passage and a closed state blocking light passage by rotating the transversal vanes;

a clutch operatively connected with the roller, the clutch being switchable between an engaged state preventing the roller from rotating in a first direction, and a disengaged state for rotation of the roller in a second direction opposite to the first direction; and an actuating module coupled with the reel and including a bead chain, the bead chain being operable to drive the reel in rotation for winding and unwinding the panel assembly, the bead chain further being operable to drive the reel in rotation in an unwinding direction while the roller is kept stationary by the clutch in the engaged state for switching the panel assembly from the closed state to the open state.

16. The window shade according to claim 15, wherein the clutch is switchable between the disengaged state and the engaged state in response to a rotation of the reel driven by a pulling action on the bead chain.

17. The window shade according to claim 15, wherein the clutch is switchable from the disengaged state to the engaged state in response to a rotation of the reel in the unwinding direction, and from the engaged state to the disengaged state in response to a rotation of the reel in a winding direction.

18. The window shade according to claim 17, wherein the clutch remains in the engaged state while the reel continuously rotates for unwinding the panel assembly, and in the disengaged state while the reel continuously rotates for winding the panel assembly, the roller being rotatable in the second direction while the reel rotates for winding the panel assembly.

19. The window shade according to claim 15, further including an idler roller in contact with a portion of the panel assembly between the reel and the roller.

20. The window shade according to claim 15, wherein the second pivot axis is located vertically lower or higher than the first pivot axis.

21. The window shade according to claim 15, wherein the clutch is disposed inside the roller.

22. The window shade according to claim 15, wherein the roller is pivotally assembled about a fixed shaft portion attached to the head frame, and the clutch includes:

a guide track provided on the fixed shaft portion, the guide track including a closed-loop portion running circumferentially around the fixed shaft portion, and a stop portion connected with the closed-loop portion;

a guide slot provided inside the roller and overlapping partially with the guide track; and a running member guided for movement along the guide slot and the guide track, wherein the running member is engaged with the stop portion when the clutch is in the engaged state.

23. The window shade according to claim 22, wherein the roller rotates around the fixed shaft portion and the running member moves along the closed-loop portion when the reel rotates for winding the panel assembly.

24. A window shade comprising:

a head frame;

a reel pivotally connected with the head frame and rotatable about a first pivot axis;

a roller disposed at a position spaced apart from the reel and pivotally connected with the head frame about a second pivot axis;

a panel assembly connected with the reel and including a first and a second panel, and a plurality of transversal vanes that are respectively connected with the first and second panels, the reel being rotatable to wind and unwind the panel assembly with the first panel remaining in contact with the roller, and the panel assembly being switchable between an open state for light passage and a closed state blocking light passage by rotating the transversal vanes; and a clutch operatively connected with the roller, the clutch being switchable between an engaged state preventing the roller from rotating in a first direction, and a disengaged state for rotation of the roller in a second direction opposite to the first direction;

wherein the reel is rotatable in an unwinding direction while the roller is kept stationary by the clutch in the engaged state for switching the panel assembly from the closed state to the open state; and wherein the clutch is switchable from the disengaged state to the engaged state in response to a rotation of the reel in the unwinding direction, and from the engaged state to the disengaged state in response to a rotation of the reel in a winding direction.

25. The window shade according to claim 24, wherein the clutch remains in the engaged state while the reel continuously rotates for unwinding the panel assembly, and in the disengaged state while the reel continuously rotates for winding the panel assembly, the roller being rotatable in the second direction while the reel rotates for winding the panel assembly.

* * * * *